US011060357B2

(12) United States Patent
Spencer et al.

(10) Patent No.: US 11,060,357 B2
(45) Date of Patent: Jul. 13, 2021

(54) EARTH-BORING TOOLS HAVING A SELECTIVELY TAILORED GAUGE REGION FOR REDUCED BIT WALK AND METHOD OF DRILLING WITH SAME

(71) Applicant: Baker Hughes Holdings LLC, Houston, TX (US)

(72) Inventors: Reed W. Spencer, Spring, TX (US); Brad Pierce, Houston, TX (US); Ethan Thomas Walkowiak, New Kensington, PA (US); Bobby James Martha, Midland, TX (US); Hector David Arambula-Cantu, San Antonio, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 16/147,041

(22) Filed: Sep. 28, 2018

(65) Prior Publication Data

US 2019/0100968 A1 Apr. 4, 2019

Related U.S. Application Data

(60) Provisional application No. 62/565,375, filed on Sep. 29, 2017.

(51) Int. Cl.
*E21B 12/00* (2006.01)
*E21B 7/04* (2006.01)
(Continued)

(52) U.S. Cl.
CPC ..... *E21B 12/00* (2013.01); *E21B 7/04* (2013.01); *E21B 7/064* (2013.01); *E21B 10/42* (2013.01);
(Continued)

(58) Field of Classification Search
CPC ..... E21B 12/00; E21B 10/42; E21B 10/55; E21B 7/04; E21B 7/064; E21B 17/1092
See application file for complete search history.

(56) References Cited

U.S. PATENT DOCUMENTS 4,499,795 A 2/1985 Radtke
4,545,441 A 10/1985 Williamson
(Continued)

FOREIGN PATENT DOCUMENTS

EP 0219992 A2 4/1987
EP 1116858 B1 2/2005
(Continued)

OTHER PUBLICATIONS

International Written Opinion for International Application No. PCT/US2018/053568, dated Feb. 22, 2019, 10 pages.
(Continued)

*Primary Examiner* — Nicole Coy
*Assistant Examiner* — Yanick A Akaragwe
(74) *Attorney, Agent, or Firm* — TraskBritt

(57) ABSTRACT

A drill bit comprises a bit body having a longitudinal axis and a blade extending radially outward from the longitudinal axis along a face region and axially along a gauge region. A gauge region includes a gauge feature and first and second recessed regions extending axially above and below the gauge feature, respectively. The gauge feature comprises an outermost surface extending radially beyond outer surfaces of the blade in the recessed regions. A method of drilling a borehole comprises rotating the bit about the longitudinal axis, engaging a formation with cutting elements mounted to the face region, and increasing a lateral force applied substantially perpendicular to the longitudinal axis such that radially outer surfaces in the gauge region engage the formation and such that side cutting exhibited by the bit is
(Continued)

initially minimal and substantially constant and subsequently increases in a substantially linear manner with increasing lateral force.

17 Claims, 18 Drawing Sheets

(51) Int. Cl.

| | |
|---|---|
| ***E21B 10/42*** | (2006.01) |
| ***E21B 10/55*** | (2006.01) |
| ***E21B 7/06*** | (2006.01) |
| ***E21B 17/10*** | (2006.01) |
| ***E21B 10/43*** | (2006.01) |
| ***E21B 10/54*** | (2006.01) |
| *B22F 5/00* | (2006.01) |
| *E21B 10/567* | (2006.01) |
| *E21B 10/62* | (2006.01) |

(52) U.S. Cl.
CPC ..... *E21B 10/43* (2013.01); *E21B 10/54* (2013.01); *E21B 10/55* (2013.01); *E21B 17/1092* (2013.01); *B22F 2005/001* (2013.01); *E21B 10/5673* (2013.01); *E21B 10/62* (2013.01)

(56) References Cited

U.S. PATENT DOCUMENTS

| | | | |
|---|---|---|---|
| 4,583,574 | A | 4/1986 | Pallmann |
| 5,004,057 | A | 4/1991 | Tibbitts et al. |
| 5,163,524 | A | 11/1992 | Newton et al. |
| 5,437,343 | A | 8/1995 | Cooley et al. |
| 5,456,141 | A | 10/1995 | Ho |
| 5,608,162 | A | 3/1997 | Ho |
| 5,678,644 | A | 10/1997 | Fielder |
| 5,937,958 | A | 8/1999 | Mensa-Wilmot et al. |
| 5,957,223 | A | 9/1999 | Doster et al. |
| 5,967,245 | A | 10/1999 | Garcia et al. |
| 5,967,246 | A | 10/1999 | Caraway et al. |
| 5,967,247 | A | 10/1999 | Pessier |
| 6,006,845 | A | 12/1999 | Illerhaus et al. |
| 6,112,836 | A | 9/2000 | Spaar et al. |
| 6,260,636 | B1 | 7/2001 | Cooley et al. |
| 6,321,862 | B1 | 11/2001 | Beuershausen et al. |
| 6,349,780 | B1 | 2/2002 | Beuershausen |
| 6,394,198 | B1 | 5/2002 | Hall et al. |
| 6,394,199 | B1 | 5/2002 | Skyles et al. |
| 6,427,792 | B1 | 8/2002 | Roberts et al. |
| 6,427,797 | B1 | 8/2002 | Chang |
| 6,484,822 | B2 | 11/2002 | Watson et al. |
| 6,640,913 | B2 | 11/2003 | Lockstedt et al. |
| 6,926,099 | B2 | 8/2005 | Thigpen et al. |
| 6,935,444 | B2 | 8/2005 | Lund et al. |
| 7,318,492 | B2 | 1/2008 | Watson et al. |
| 7,798,256 | B2 | 9/2010 | Hoffmaster et al. |
| 7,860,696 | B2 | 12/2010 | Chen |
| 7,926,596 | B2 | 4/2011 | Shen et al. |
| 8,051,923 | B2 | 11/2011 | Chen et al. |
| 8,061,456 | B2 | 11/2011 | Patel et al. |
| 8,127,863 | B2 | 3/2012 | Durairajan et al. |
| 8,145,465 | B2 | 3/2012 | Chen |
| 8,172,010 | B2 * | 5/2012 | Strachan ..... E21B 10/43 175/391 |
| 8,356,679 | B2 | 1/2013 | Chen et al. |
| 8,727,036 | B2 | 5/2014 | Johnson et al. |
| 8,794,356 | B2 | 8/2014 | Lyons et al. |
| 8,820,441 | B2 | 9/2014 | Shamburger |
| 8,869,919 | B2 | 10/2014 | Shen et al. |
| 8,899,352 | B2 | 12/2014 | Johnson et al. |
| 8,905,163 | B2 * | 12/2014 | Chen ..... E21B 7/04 175/408 |
| 8,973,685 | B2 | 3/2015 | Ersan et al. |
| 8,978,787 | B2 | 3/2015 | Ersan et al. |
| 9,080,390 | B2 | 7/2015 | Ersan et al. |
| 9,145,739 | B2 | 9/2015 | Hoffmaster et al. |
| 9,200,484 | B2 | 12/2015 | Cleboski et al. |
| 9,677,344 | B2 | 6/2017 | Radford et al. |
| 2001/0000885 | A1 | 5/2001 | Beuershausen et al. |
| 2009/0020339 | A1 | 1/2009 | Sherwood, Jr. |
| 2010/0089648 | A1 | 4/2010 | Hall et al. |
| 2010/0089662 | A1 | 4/2010 | Mumma |
| 2011/0005837 | A1 | 1/2011 | Hoffmaster et al. |
| 2013/0098692 | A1 | 4/2013 | Wardley et al. |
| 2013/0153306 | A1 * | 6/2013 | Burhan ..... E21B 10/26 175/406 |
| 2013/0180781 | A1 | 7/2013 | Ersan et al. |
| 2014/0116790 | A1 | 5/2014 | Hall et al. |
| 2015/0152723 | A1 | 6/2015 | Hay |
| 2016/0168914 | A1 | 6/2016 | Gonzalez |
| 2018/0163482 | A1 | 6/2018 | Vempati et al. |
| 2019/0040691 | A1 | 2/2019 | Mayer et al. |

FOREIGN PATENT DOCUMENTS

| | | | |
|---|---|---|---|
| WO | 2017/132052 | A1 | 8/2017 |
| WO | 2018/118043 | A1 | 6/2018 |

OTHER PUBLICATIONS

International Search Report for International Application No. PCT/US2018/053568, dated Feb. 22, 2019, 3 pages.

* cited by examiner

EARTH-BORING TOOLS HAVING A SELECTIVELY TAILORED GAUGE REGION FOR REDUCED BIT WALK AND METHOD OF DRILLING WITH SAME

CROSS-REFERENCE TO RELATED APPLICATION

This application claims the benefit under 35 U.S.C. § 119(e) of U.S. Provisional Patent Application Ser. No. 62/565,375, filed Sep. 29, 2017, the disclosure of which is hereby incorporated herein in its entirety by this reference. The subject matter of this application is also related to the subject matter of PCT Application Serial No. PCT/US2018/053571, entitled "Earth-boring Tools Having a Gauge Region Configured for Reduced Bit Walk and Method of Drilling with Same," filed Sep. 28, 2018. The subject matter of this application is also related to the subject matter of PCT Application Serial No. PCT/US2018/053577, filed Sep. 28, 2018 and titled "Earth-Boring Tools Having a Gauge Insert Configured for Reduced Bit Walk and Method of Drilling with Same."

TECHNICAL FIELD

The present disclosure, in various embodiments, relates generally to earth-boring tools, such as drill bits, having radially and axially extending blades. Outer surfaces of the blades in a gauge region of the drill bits are shaped and topographically configured to limit side cutting of the bit while drilling a substantially straight portion of a borehole without limiting side cutting of the bit while drilling a curved (e.g., deviated) portion of the borehole.

BACKGROUND

Rotary drill bits are commonly used for drilling boreholes or wellbores in earth formations. One type of rotary drill bit is the fixed-cutter bit (often referred to as a "drag" bit). FIG. 1 is a cross-sectional, schematic illustration of such a conventional fixed-cutter drill bit 10. The drill bit 10 typically includes a plurality of cutting elements (not shown) secured to a face region 11 of a bit body 12. Generally, the cutting elements of the drill bit 10 have either a disk shape or a substantially cylindrical shape. A cutting surface comprising a superabrasive material, such as inter-bonded diamond particles, may be provided on a substantially circular end surface of each cutting element. Such cutting elements are often referred to as "polycrystalline diamond compact" (PDC) cutting elements. Typically, the cutting elements are fabricated separately from the bit body 12 and secured within pockets 14 formed in an outer surface 16 of the bit body 12. A bonding material such as an adhesive or, more typically, a braze alloy may be used to secure the cutting elements to the bit body 12. The drill bit 10 may be placed in a borehole such that the cutting elements are adjacent the earth formation to be drilled. As the drill bit 10 is rotated, the cutting elements scrape across and shear away the surface of the underlying formation.

The bit body 12 of the drill bit 10 is typically secured to a hardened steel shank 18 having an American Petroleum Institute (API) thread connection for attaching the drill bit 10 to a drill string. The drill string includes tubular pipe and equipment segments coupled end to end between the drill bit and other drilling equipment at the surface. Equipment such as a rotary table or top drive may be used for rotating the drill string and the drill bit 10 within the borehole. Alternatively, the shank 18 of the drill bit 10 may be coupled directly to the drive shaft of a down-hole motor, which then may be used to rotate the drill bit 10, alone or in conjunction with a rotary table or top drive.

The bit body 12 of the drill bit 10 may be formed from steel. Alternatively, the bit body 12 may be formed from a particle-matrix composite material. Such bit bodies typically are formed by embedding a steel blank in a carbide particulate material volume, such as particles of tungsten carbide (WC), and infiltrating the particulate carbide material with a liquefied metal material (often referred to as a "binder" material), such as a copper alloy, to provide a bit body substantially formed from a particle-matrix composite material. Drill bits that have a bit body formed from such a particle-matrix composite material may exhibit increased erosion and wear resistance relative to drill bits having steel bit bodies.

The process of drilling an earth formation may be visualized as a three-dimensional process, as the drill bit 10 may not only penetrate the formation linearly along a vertical axis, but is either purposefully or unintentionally drilled along a curved path or at an angle relative to a theoretical vertical axis extending into the earth formation in a direction substantially parallel to the gravitational field of the earth, as well as in a specific lateral direction relative to the theoretical vertical axis. The term "directional drilling," as used herein, means both the process of directing a drill bit along some desired trajectory through an earth formation to a predetermined target location to form a borehole, and the process of directing a drill bit along a predefined trajectory in a direction other than directly downwards into an earth formation in a direction substantially parallel to the gravitational field of the earth to either a known or unknown target.

Several approaches have been developed for directional drilling. For example, positive displacement (Moineau) type motors as well as turbines have been employed in combination with deflection devices such as bent housings, bent subs, eccentric stabilizers, and combinations thereof to effect oriented, nonlinear drilling when the drill bit 10 is rotated only by the motor drive shaft, and linear drilling when the drill bit 10 is rotated by the superimposed rotation of the motor shaft and the drill string.

Other steerable bottom hole assemblies are known, including those wherein deflection or orientation of the drill string may be altered by selective lateral extension and retraction of one or more contact pads or members against the borehole wall. One such system is the AutoTrak™ drilling system, developed by the INTEQ operating unit of Baker Hughes, a GE company, LLC, assignee of the present invention. The bottom hole assembly of the AutoTrak™ drilling system employs a non-rotating sleeve through which a rotating drive shaft extends to drive the drill bit 10, the sleeve thus being decoupled from drill string rotation. The sleeve carries individually controllable, expandable, circumferentially spaced steering ribs on its exterior, the lateral forces exerted by the ribs on the sleeve being controlled by pistons operated by hydraulic fluid contained within a reservoir located within the sleeve. Closed loop electronics measure the relative position of the sleeve and substantially continuously adjust the position of each steering rib so as to provide a steady lateral force at the bit in a desired direction. Further, steerable bottom hole assemblies include placing a bent adjustable kick off (AKO) sub between the drill bit 10 and the motor. In other cases, an AKO may be omitted and a side load (e.g., lateral force) applied to the drill string/bit to cause the drill bit 10 to travel laterally as it descends downward.

The processes of directional drilling and deviation control are complicated by the complex interaction of forces between the drill bit 10 and the wall of the earth formation surrounding the borehole. In drilling with rotary drill bits and, particularly with fixed-cutter type rotary drill bits 10, it is known that if a lateral force (indicated by arrow 28) is applied to the drill bit 10, the drill bit 10 may "walk" or "drift" from the straight path that is parallel to the intended longitudinal axis of the borehole. Many factors or variables may at least partially contribute to the reactive forces and torques applied to the drill bit 10 by the surrounding earth formation. Such factors and variables may include, for example, the "weight on bit" (WOB), the rotational speed of the bit, the physical properties and characteristics of the earth formation being drilled, the hydrodynamics of the drilling fluid, the length and configuration of the bottom hole assembly (BHA) to which the drill bit 10 is mounted, and various design factors of the drill bit including the cutting element size, radial placement, back (or forward) rake, side rake, etc.

When lateral force 28 is applied to the drill bit 10 to steer or direct the drill bit 10 away from the linear path of the substantially vertical portion of the borehole, a gauge pad 22 located in a gauge region 20 of the drill bit 10 may engage a borehole sidewall and remove formation material. The ability of the drill bit 10 to cut the borehole sidewall as opposed to the bottom of the borehole is referred to in the art as "side cutting." The amount of walk or drift may depend on the rate at which the drill bit 10 side cuts the borehole sidewall relative to an intended side cutting rate. The gauge region 20 of the drill bit 10 may also include a recessed region 24 adjacent to the gauge pad 22. By providing the recessed region 24 at the top of the gauge region 20 (e.g., adjacent to the shank 18 and distal from the face region 11 of the drill bit 10), the amount of contact between the gauge region 20 and the formation may be reduced, which enables the drill bit 10 to deviate from the vertical portion toward a substantially horizontal portion of the borehole over a shorter distance. As illustrated in FIG. 1, an outer surface 26 of the gauge region 20 within the recessed region 24 may be recessed relative to the outer surface 26 of the gauge region 20 along the gauge pad 22 by about 0.03 inch (0.0762 cm).

FIG. 2 is a graph of a line 30 illustrating the amount of side cutting of the drill bit 10 as a function of increasing lateral force 28 applied to the drill bit 10. As illustrated in FIG. 2, at low lateral forces, such as lateral forces less than about 500 pounds (226.7 kg), the amount of side cutting increases rapidly with increasing lateral force. Accordingly, this region of the line 30 may be referred to herein as the "sensitive region" as the bit 10 is highly responsive to (e.g., sensitive to) minimal applications of lateral force. At moderate lateral forces, such as lateral forces greater than 500 pounds (226.7 kg) and up to about 1500 pounds (680.2 kg), the amount of side cutting increases at a lower rate than in the sensitive region. This region of the line 30 may be referred to herein as the "linear region" as the amount of side cutting increases with increasing lateral force in a substantially constant, linear manner. At high lateral forces, such as lateral forces greater than about 1500 pounds (680.2 kg), the side cutting capabilities of the bit maximizes and the amount of side cutting for increasing lateral forces plateaus, or caps. Accordingly, this region of the line 30 may be referred to herein as the "cap region."

BRIEF SUMMARY

In some embodiments, a drill bit for removing subterranean formation material in a borehole comprises a bit body comprising a longitudinal axis and a blade extending radially outward from the longitudinal axis along a face region of the bit body and extending axially along a gauge region of the bit body. A gauge feature is provided on the blade in the gauge region. A first recessed region extends axially above the gauge feature and a second recessed region extends axially below the gauge feature. The gauge feature comprises an outermost surface extending radially beyond outer surfaces of the blade in the first and second recessed regions.

In other embodiments, a drill bit for removing subterranean formation material in a borehole comprises a bit body comprising a longitudinal axis and a blade extending radially outward from the longitudinal axis along a face region of the bit body and extending axially along a gauge region of the bit body. A gauge feature is provided on the blade in the gauge region adjacent a crown chamfer of the bit body. The gauge feature comprises an outermost surface of the gauge region extending radially beyond remaining outer surfaces of the gauge region. The remaining outer surfaces of the gauge region extend between the gauge feature and a gauge trimmer provided in the gauge region adjacent to the face region of the bit body.

In further embodiments, a drill bit for removing subterranean formation material in a borehole comprises a bit body comprising a longitudinal axis and a blade extending radially outward from the longitudinal axis along a face region of the bit body and extending axially along a gauge region of the bit body. A gauge feature is provided on the blade in the gauge region and a recessed region extending axially below the gauge feature. The gauge feature comprises an outermost surface extending radially beyond an outer surface of the blade in the recessed region. At least one of the outermost surface of the gauge feature and the outer surface of the blade in the recessed region is radially recessed relative to an outer diameter of the bit.

In yet other embodiments, a method of drilling a borehole in a subterranean formation comprises rotating a bit about a longitudinal axis thereof, engaging a subterranean formation with a plurality of cutting elements mounted to a face of the bit, and increasing a lateral force applied on the bit in a direction substantially perpendicular to the longitudinal axis such that radially outer surfaces of a blade in a gauge region of the bit engage the subterranean formation and such that side cutting exhibited by the bit is initially minimal and substantially constant and subsequently increases in a substantially linear manner with increasing lateral force.

In yet additional embodiments, a method of drilling a borehole in a subterranean formation comprises rotating a bit about a longitudinal axis thereof and engaging a subterranean formation with at least a portion of a gauge region of a blade of the bit. The gauge region comprises at least one recessed region comprising a radially outer surface of the blade and at least one gauge feature comprising a radially outermost surface extending radially beyond the radially outer surface of the blade in the at least one recessed region. The method further comprises increasing a tilt angle of the bit such that the radially outermost surface of the at least one gauge feature and the radially outer surface of the at least one recessed region are consecutively engaged with the subterranean formation with increasing tilt angle.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 2:
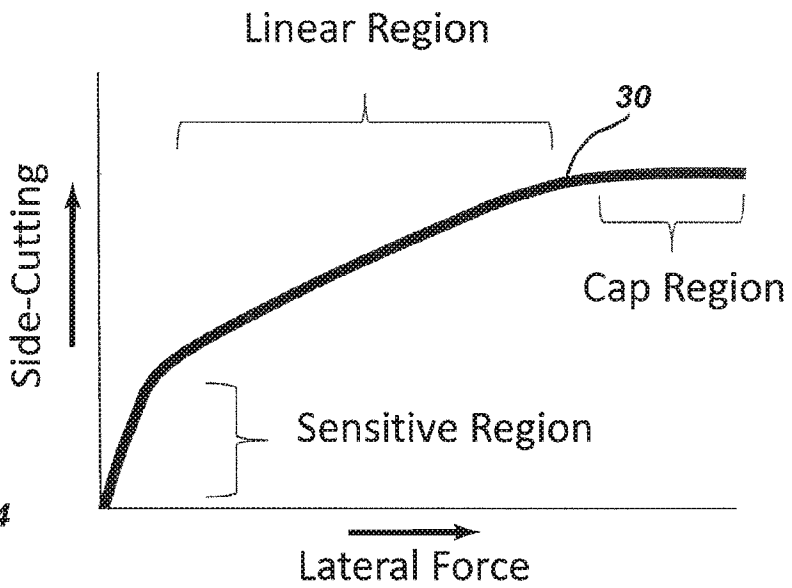
FIG. 2 is a graph illustrating the relationship between side cutting of the drill bit of FIG. 1 as a function of lateral force applied thereto.

The illustrations presented herein are not meant to be actual views of any particular cutting structure, drill bit, or component thereof, but are merely idealized representations which are employed to describe embodiments of the present disclosure. For clarity in description, various features and elements common among the embodiments may be referenced with the same or similar reference numerals.

As used herein, directional terms, such as "above," "below," "up," "down," "upward," "downward," "top," "bottom," "upper," "lower," "top-most," "bottom-most," and the like, are to be interpreted relative to the earth-boring tool or a component thereof in the orientation of the figures.

As used herein, the terms "downhole" and "uphole" refer to locations on an earth-boring tool, such as a drill bit described herein, relative to a surface of the tool engaged with a bottom of a wellbore to remove formation material. Accordingly, an "uphole" portion of the tool is located closer to (e.g., proximate to, adjacent to) a shank of a bit or to an associated drilling string or bottom hole assembly as compared to a "downhole" portion that is located closer to a face of a bit in engagement with the bottom of the wellbore during a drilling operation.

As used herein, the terms "longitudinal," "longitudinally," "axial," or "axially" refers to a direction parallel to a longitudinal axis (e.g., rotational axis) of the drill bit described herein. For example, a "longitudinal dimension" or "axial dimension" is a dimension measured in a direction substantially parallel to the longitudinal axis of the drill bit described herein.

As used herein, the terms "radial" or "radially" refers to a direction transverse to a longitudinal axis of the drill bit described herein and, more particularly, refers to a direction as it relates to a radius of the drill bit described herein. For example, as described in further detail below, a "radial dimension" is a dimension measured in a direction substantially transverse (e.g., perpendicular) to the longitudinal axis of the drill bit as described herein.

As used herein, the term "circumferential" or "circumferentially" refers to a direction with reference to a circumference (e.g., a periphery) of the drill bit described herein which may include, but is not limited to, an outer diameter of the drill bit.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, the term "earth-boring tool" means and includes any tool used to remove formation material and to form a bore (e.g., a borehole) through a earth formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "cutting element" means and includes an element separately formed from and mounted to an earth-boring tool that is used to engage an earth (e.g., subterranean) formation to remove formation material therefrom during operation of the earth-boring tool to form or enlarge a borehole in the formation. By way of non-limiting example, the term "cutting element" includes tungsten carbide inserts and inserts comprising superabrasive materials as described herein.

As used herein, the term "superabrasive material" means and includes any material having a Knoop hardness value of about 3,000 Kgf/mm$^2$ (29,420 MPa) or more such as, but not limited to, natural and synthetic diamond, cubic boron nitride and diamond-like carbon materials.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

Figure 3:
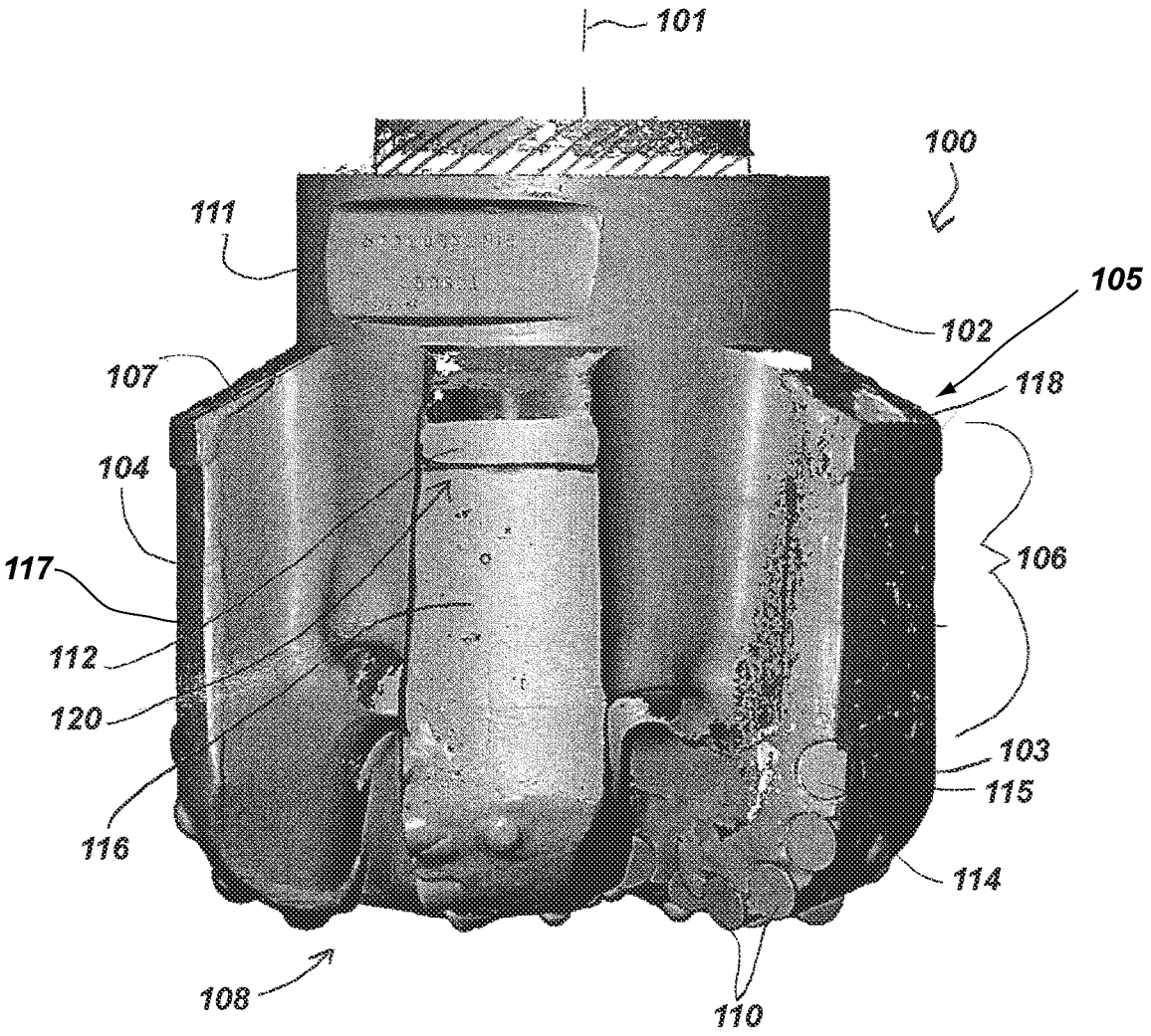
FIG. 3 is side view of a drill bit according to embodiments of the present disclosure.
Figure 4:
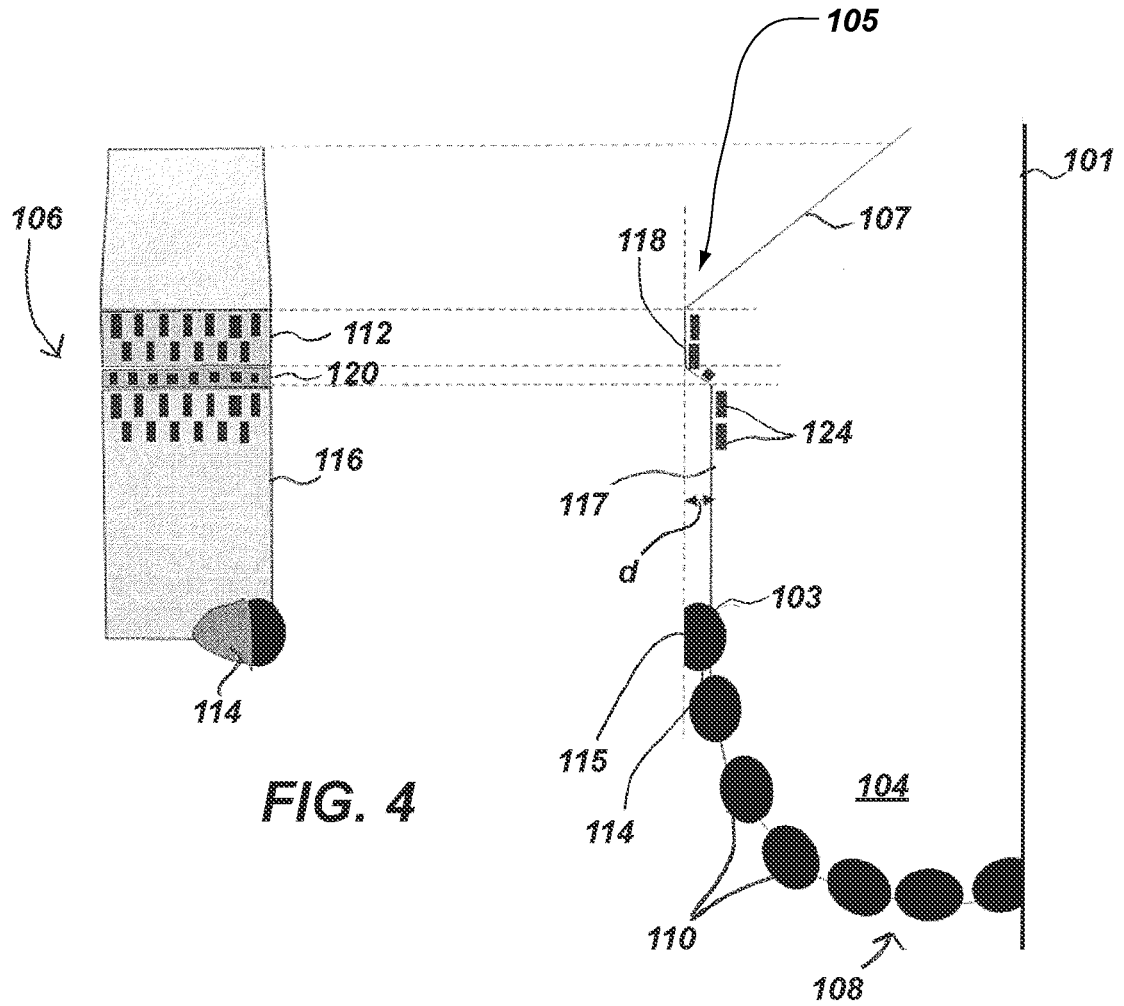
FIG. 4 is a corresponding side view and profile view of a gauge region of the drill bit of FIG. 3.

FIGS. 3 and 4 illustrate a side view and corresponding profile views, respectively, of a blade 104 of a fixed-cutter earth-boring rotary drill bit 100 according to embodiments of the present disclosure. The drill bit 100 includes a bit body 102 having a central axis 101 about which the drill bit 100 rotates in operation. The bit body 102 comprises a plurality of blades 104 extending radially outward from the central axis 101 toward a gauge region 106 of the blade 104 and extending axially along the gauge region 106. Outer surfaces of the blades 104 may define at least a portion of a face 108 and the gauge region 106 of the drill bit 100.

A row of cutting elements 110 may be mounted to each blade 104 of the drill bit 100. For example, cutting element pockets may be formed in the blades 104, and the cutting elements 110 may be positioned in the cutting element pockets and bonded (e.g., brazed, bonded, etc.) to the blades 104. As previously described with reference to the conventional drill bit 10, the cutting elements 110 may comprise, for example, a polycrystalline compact in the form of a layer of hard polycrystalline material, also known in the art as a polycrystalline table, that is provided on (e.g., formed on or subsequently attached to) a supporting substrate with an interface therebetween. In some embodiments, the cutting elements 110 may comprise polycrystalline diamond compact (PDC) cutting elements each including a volume of polycrystalline diamond material provided on a ceramic-metal composite material substrate, as is known in the art. Though the cutting elements 110 in the embodiment depicted in FIG. 3 are cylindrical or disc-shaped, the cutting elements 110 may have any desirable shape, such as a dome, cone, chisel, etc. In operation, the drill bit 100 may be rotated about the central axis 101. As the bit 100 is rotated under applied WOB, the cutting elements 110 may engage a subterranean formation mounted in the face 108 of the bit such that the cutting elements 110 exceed a compressive strength of the subterranean formation and penetrate the formation to remove formation material therefrom in a shearing cutting action.

At least one of the cutting elements 110 may be mounted within the gauge region 106 instead of on the face 108 of the bit 100. Such cutting elements are referred to in the art as gauge trimmers 114 as such a cutting element defines the outermost gauge dimension, or diameter, for the drill bit 100. The gauge trimmer 114 may be provided at a bottom 103 of the gauge region 106. The gauge trimmer 114 may comprise a cutting element having a linear cutting edge 115 aligned substantially parallel to the central axis 101 of drill bit 100. The linear cutting edges 115 of gauge trimmers 114 may be formed by grinding, milling, or otherwise removing at least a portion of a sharp cutting edge formed at the intersection of a planar cutting face and a peripheral side surface of the polycrystalline table. The gauge trimmers 114 may be mounted on the blades 104 and may be positioned at the furthermost radial distance from the central axis 101 of the bit 100 (e.g., the outer periphery of the drill bit 100) and the final diameter of the borehole being formed as a result of the drill bit 100 engaging, cutting, and removing formation material in the borehole. More particularly, the linear cutting edge 115 of the gauge trimmers 114 may be the radially outermost surface of the gauge trimmer 114, may define an outer diameter of the bit 100, and may define the final diameter of the borehole being formed as a result of the gauge trimmer 114 engaging, cutting, and removing formation material in the borehole. A dashed line is illustrated in FIG. 3 and subsequent figures for the purposes of illustrating the outer diameter of the bit 100 and for purposes of comparing the radial extension of the blade 104 in a gauge region relative to the outer diameter of the bit 100.

The gauge region 106 may be comprised of a gauge feature 112, a recessed region 116, and a transition region 120 therebetween. In some embodiments, the gauge feature 112 may comprise a radially outermost surface 118 positioned at the furthermost radial distance from the central axis of the bit 100 and, in conjunction with the gauge trimmers 114, may define the final diameter of the borehole being formed as a result of the gauge feature 112 engaging, cutting, and removing formation material in the borehole. Accordingly, the outermost surface 118 of the gauge feature 112 may be radially coextensive with (e.g., aligned with) the linear cutting edge 115 of the gauge trimmers 114. The outermost surface 118 may extend radially beyond any remaining outer surfaces of the blade 104, such as outer surfaces in recessed region 116 and transition region 120, extending between the gauge feature 112 and the gauge trimmer 114.

As illustrated in FIGS. 3 and 4, the gauge feature 112 may be located at a top 105 (e.g., uphole end) of the gauge region 106 adjacent a crown chamfer 107 of the bit 100 proximal to a shank 111 of the bit 100 and distal from the face 108 of the bit 100. The gauge feature 112 may comprise a gauge pad. The outermost surface 118 of the gauge feature 112 may comprise a substantially blunt or flat surface for contacting the formation. The gauge feature 112 may have a width, or a dimension measured at least partially circumferentially about a periphery of the bit 100, and a length, or an axial dimension measured at least partially axially along the gauge region 106 of the bit 100. In some embodiments, the width of the gauge feature 112 may be coextensive with a width of the blade 104 on which it is provided. In other embodiments, the width of the gauge feature 112 may be less than a width of the blade 104 on which it is provided. The length of the gauge feature 112 may be less than a length of the gauge region 106 of the blade 104 on which the gauge feature 112 is provided.

The outermost surface 118 may have a sufficient amount of bearing surface area to contact a sidewall of the borehole so as to provide a bearing surface to generally distribute weight (e.g., force) applied by the formation against the bit 100, including lateral forces previously described herein. At low lateral forces, such as forces less than about 500 pounds (226.7 kg) depending at least upon the formation material and the compressive strength thereof and upon the size of the bit 100, the gauge feature 112 may ride, rub on, or otherwise engage the borehole sidewall without substantially failing the formation material of the sidewall (e.g., without exceeding the compressive strength of the formation). In other words, at low lateral forces the gauge feature 112 does not provide substantial side cutting action.

The recessed region 116 may occupy and define a majority of a surface area of the gauge region 106. Outer surfaces of the blade 104 within the recessed region 116 may be recessed (e.g., radially undersized) relative to the gauge feature 112 such that a surface 117 of the recessed region 116 does not extend to the outermost gauge dimension. The outermost surface 118 may extend radially beyond the surface 117 of the recessed region 116 by a distance d. In other words, the surface 117 of the recessed region 116 may be radially recessed relative to the outermost surface 118 by the distanced. In some embodiments, the distance d may be between about 0.02 inch (0.0508 cm) and 0.15 inch (0.381 cm).

Figure 7:
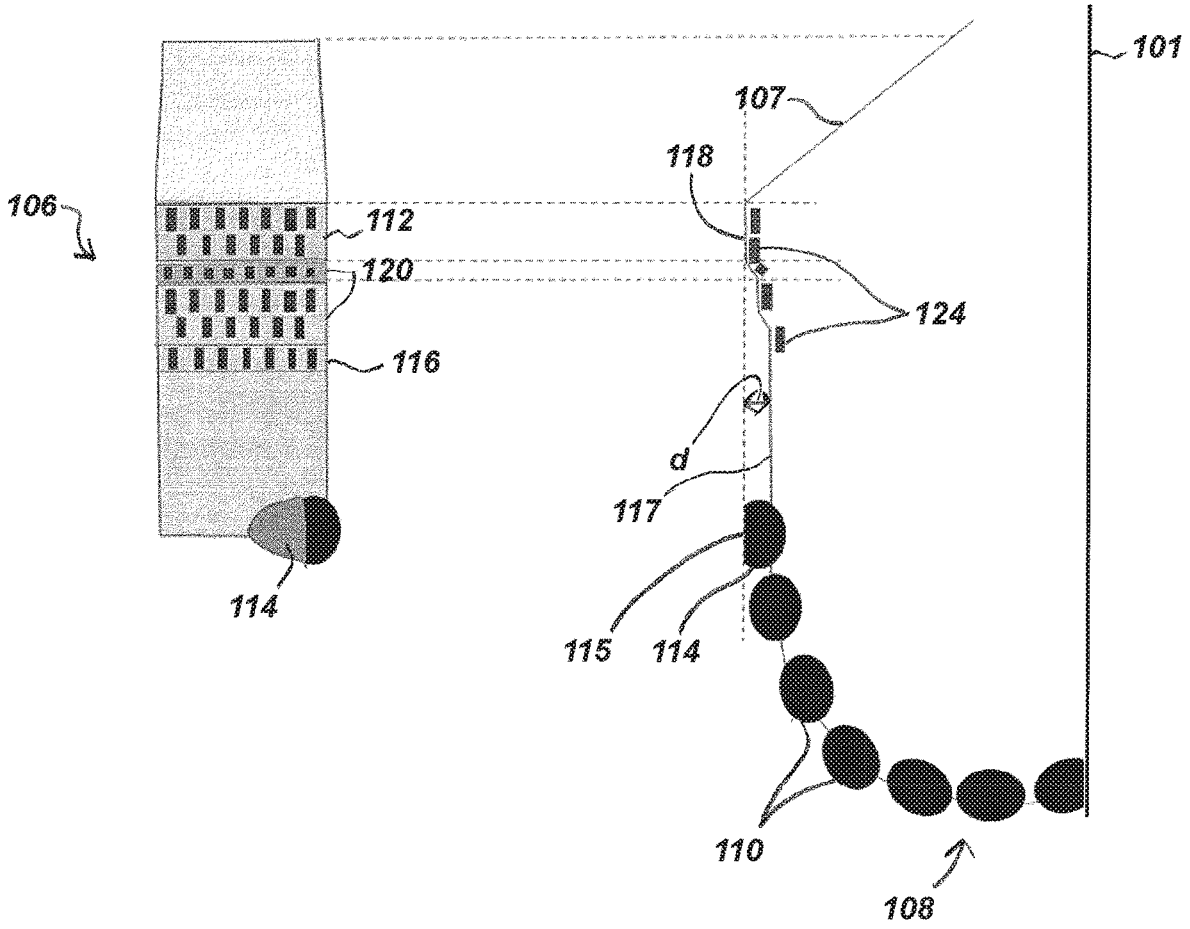
FIGS. 7-12 are corresponding side views and profile views of gauge regions according to additional embodiments of the present disclosure.

As illustrated in FIG. 4, the transition region 120 may be provided between the gauge feature 112 and the recessed region 116 along the gauge region 106. The outer surface of the blades 104 in the transition region 120 may be tapered so as to provide a gradual change in the radial extension of the blade 104 in the gauge region 106 between the gauge feature 112 and recessed region 116. In other embodiments, such as illustrated in FIG. 7, the transition region 126 may be stepped having alternating sloped surfaces along which the radial extension of the outer surfaces of the blade 104 decreases and level surfaces along which the radial extension of outer surfaces of the blade 104 in the gauge region 106 remains substantially constant.

One or more of the outer surfaces of the blade 104 in the gauge region 106 may be provided with wear-resistant inserts 124 to inhibit excessive wear of the blades 104. The wear-resistant inserts 124 may comprise coatings, discs, bricks, or other inserts formed of wear-resistant material that may be coupled, bonded, at least partially embedded within, or otherwise attached to radially outer surfaces of the blades 104. The wear-resistant inserts 124 may comprise tungsten carbide, diamond grit-filled tungsten carbide, diamond-like carbon materials, polycrystalline diamond materials, thermally stable products such as thermally stable polycrystalline diamond, hardfacing materials, and other abrasion-resistant materials. As illustrated in FIG. 4, one or more of the gauge feature 112, transition region 126, and the recessed region 116 may be provided with a plurality of discrete, wear-resistant inserts 124.

Figure 1:
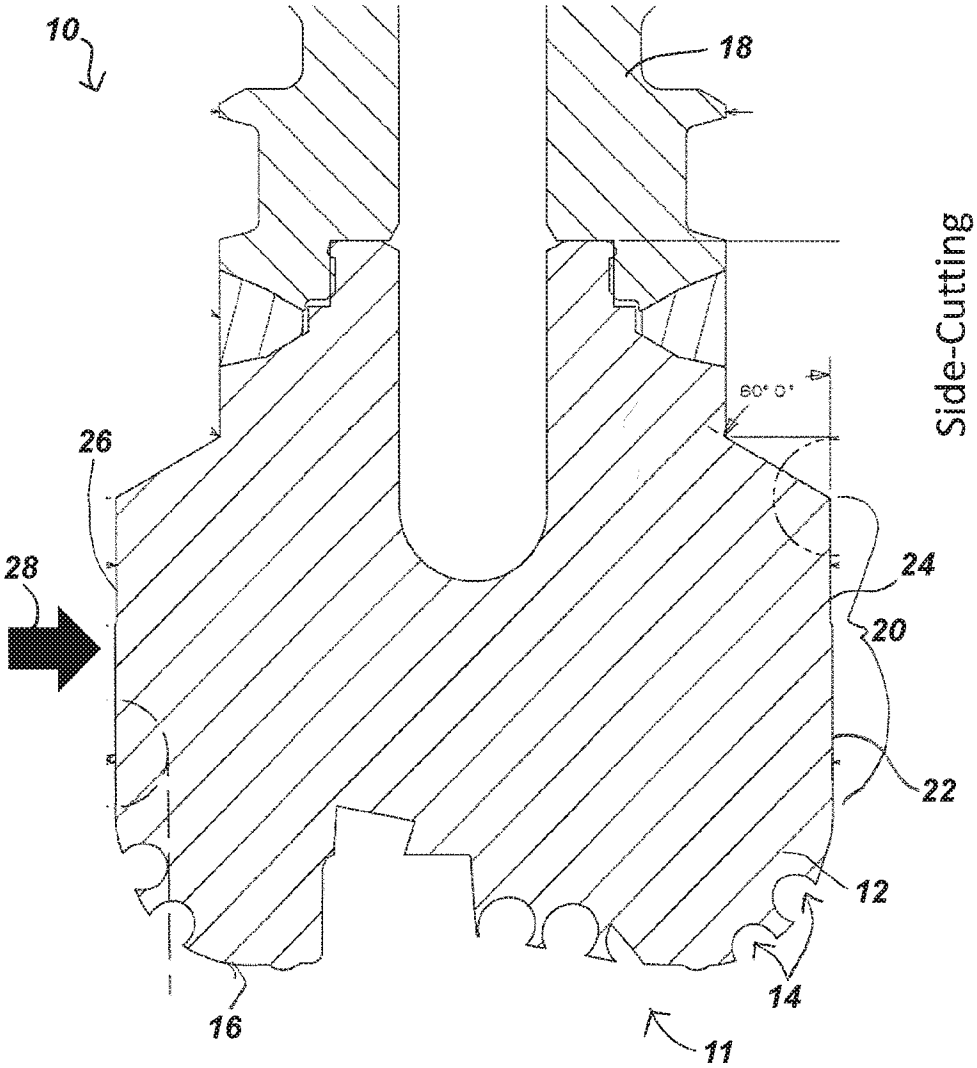
FIG. 1 is a cross-sectional view of a drill bit of a conventional drill bit.
Figure 5A:
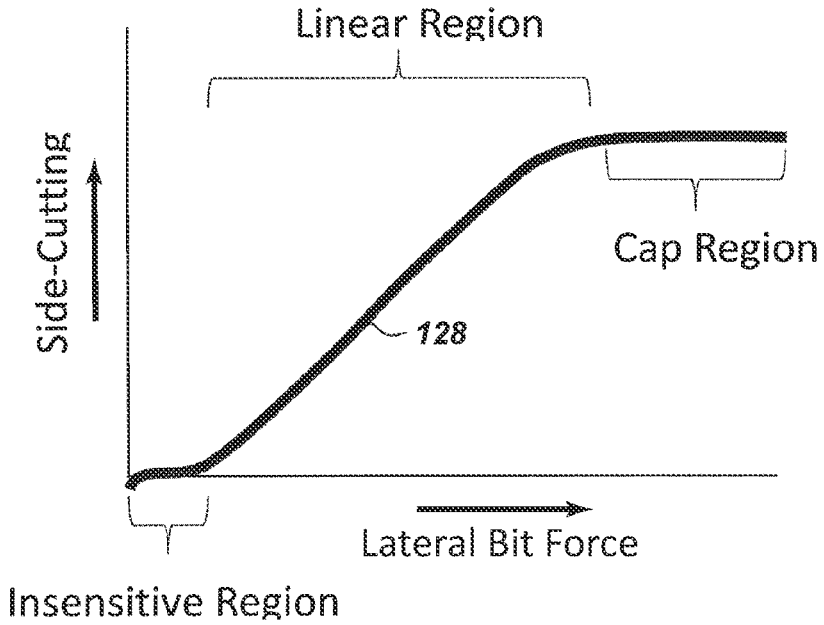
FIG. 5A is a graph illustrating the relationship between side cutting of the drill bit of FIG. 3 as a function of lateral force applied thereto.
Figure 5B:
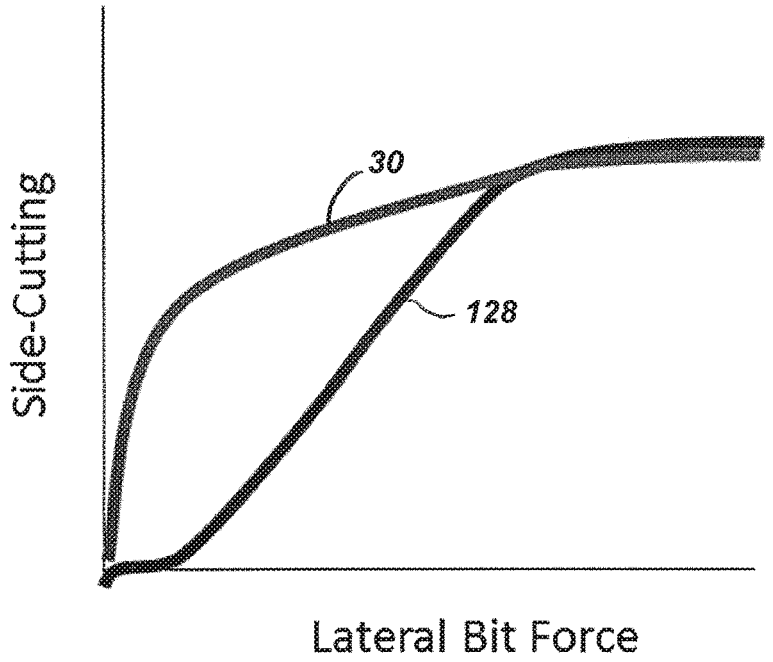
FIG. 5B is a comparative graph of FIGS. 2 and 5A.

FIG. 5A is a graph of a line 128 illustrating the amount of side cutting of the drill bit 100 as a function of increasing lateral force applied to the bit 100 during operation thereof. FIG. 5B is a comparative graph of the line 30 and line 128 of FIGS. 2 and 5A, respectively. As illustrated in FIG. 5A, at low lateral forces, such as lateral forces less than about 500 pounds (226.7 kg) depending at least upon the formation material and the compressive strength thereof and upon the size of the bit 100, the amount of side cutting exhibited by bit 100 is minimal and relatively constant. This region of the line 128 is referred to as the "insensitive region" as the bit 100 is minimally responsive to (e.g., insensitive to) minimal applications of lateral force. Such low lateral forces are generally unintentionally applied to the drill bit 100 while the bit 100 is forming a straight portion of the borehole, such as a vertical portion or a horizontal (e.g., lateral) portion of the borehole. Side cutting while drilling the straight portion of the borehole may be substantially avoided as side cutting while forming the straight portion of the borehole leads to walk or drift of the bit 100 and causes the borehole to deviate from its intended path. Furthermore, side cutting while drilling the straight portion of the borehole may also lead to undesirable tortuosity, torque, and drag problems, which may lower the quality of the borehole and limit the length of the straight portion thereof that can be formed. Accordingly, the insensitivity of the drill bit 100 to low lateral forces is desirable as opposed to the sensitivity of the conventional bit 10 as previously described with reference to FIGS. 1 and 2 because limiting side cutting in the straight portion of the borehole will decrease the potential walk or drift of the bit 100 and improve the quality and length of the straight portions of the borehole.

While side cutting may be undesirable at low lateral forces as previously described, side cutting may be desirable at greater side loads. Such side cutting enables the bit 100 to directionally drill so as to form deviated or curved portions of the borehole in an efficient manner. Accordingly, at moderate lateral forces, such as lateral forces greater than 500 pounds (226.7 kg) and up to about 1500 pounds (680.2 kg), depending at least upon the formation material and the compressive strength thereof and upon the size of the bit 100, the amount of side cutting exhibited by the gauge region 106 of the bit 100 begins to increase in a substantially constant, linear manner. This region of the line 128 is referred to as the "linear region." At high lateral forces, such as lateral forces greater than about 1500 pounds (680.2 kg) depending at least upon the formation material and the compressive strength thereof and upon the size of the bit 100, the amount of side cutting exhibited by the bit 100 is maximized and plateaus, or caps. Accordingly, this region of the line 128 is referred to as the "cap region." In view of the foregoing, outer surfaces of the blades 104 in a gauge region 106 of the drill bit 100 may be shaped and topographically configured to limit side cutting of the bit 100 while drilling a substantially straight portion of a borehole without limiting side cutting of the bit 100 while drilling a curved (e.g., deviated) portion of the borehole. Overall, as illustrated in FIG. 5A, as the lateral force applied on the bit 100 increases such that radially outer surfaces of the blade 104 in the gauge region 106 of the bit 100 engage the subterranean formation, the side cutting exhibited by the bit 100 may be initially minimal and substantially constant, may subsequently increase in a substantially linear manner with increasing lateral force, and may be subsequently maximized and substantially constant.

Without being bound by any particular theory, the amount of side cutting performed by the gauge region 106 of the blade 104 may be at least partially a function of the surface area of the gauge region 106 in contact with the formation material at a given lateral force. Therefore, according to embodiments of the present disclosure, the drill bit 100 and, more particularly, the gauge region 106 and other gauge regions described herein are designed and topographically configured to selectively control the surface area of the gauge region 106 in contact with the sidewall of the borehole as a function of bit tilt angle of the bit 100 and/or lateral force applied to the bit 100. As used herein, the term "bit tilt angle" refers to an angle measured between the central axis 101 of the bit 100 and a borehole axis extending centrally through the borehole. As the drill bit 100 is operated to form the straight portion of the borehole, the drill bit 100 is generally oriented such that the central axis 101 of the bit 100 is substantially coaxial with the borehole axis. The bit tilt angle of the bit 100 may be at least partially a function of the lateral force applied to the bit 100 such that as the amount of lateral force applied to the bit 100 increases, the bit tilt angle of the bit 100 increases correspondingly. When the bit tilt angle is zero (e.g., when the central axis 101 is substantially coaxial with the borehole axis), the gauge region 106 and, more particularly, the gauge feature 112 may or may not be in contact with the formation. When the bit tilt angle is greater than zero, at least a portion of the gauge region 106 may come into contact with the borehole sidewall and remove formation material when sufficient lateral force is applied. The gauge region 106 of bit 100 may be designed such that the anticipated surface area of the gauge region 106 contacting the formation at a given lateral force and/or given bit tilt angle is selectively controlled and/or tailored.

Figure 6:
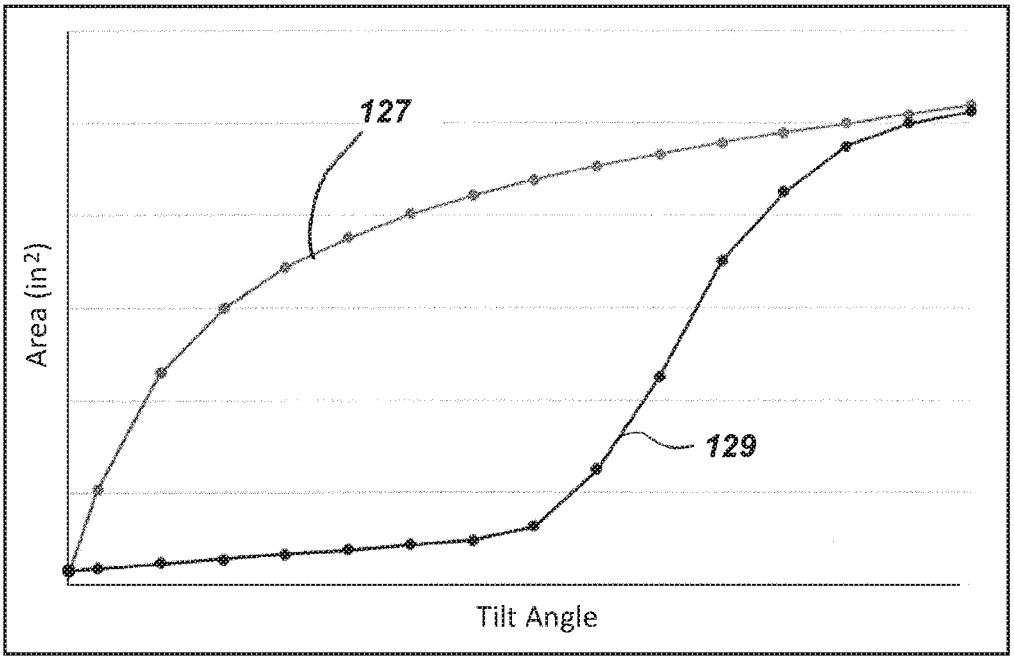
FIG. 6 is a graph illustrating the relationship between surface area engagement of the gauge feature of FIG. 3 as a function of bit tilt angle.

FIG. 6 is a graph of a line 129 illustrating a surface area of the gauge region 106 in contact with the formation material of the borehole sidewall and a line 127 illustrating a surface area of the gauge region 20 of the drill bit 10 in contact with the formation material of the borehole sidewall as a function of increasing bit tilt angle. When lateral forces are applied to the bit 100 and the central axis 101 of the bit 100 is inclined relative to the borehole axis, the radially outermost surface 118 of the gauge feature 112 may contact the formation material prior to the remaining regions of the gauge region 106 including the transition region 120 and recessed region 116. Further, the surface area of the radially outermost surface 118 may be selected such that as the bit tilt angle increases with application of low lateral forces as previously described herein, the surface area of the gauge region 106 in contact with the formation remains minimal and substantially constant. As a result, the amount of side cutting performed by the gauge region 106 may be limited and substantially constant over the range of low lateral forces as previously described with regard to the insensitive region of the line 128 of FIG. 5A. Further, the size of the insensitive region, or the range of lateral forces over which the amount of side cutting is minimal and relatively constant, can be reduced or extended by decreasing or increasing, respectively, the surface area of the radially outermost surface 118 of the gauge feature 112.

Comparing line 127 to line 129, the surface area of the gauge region 20 in contact with the formation material increases rapidly as the bit tilt angle begins to increase while the surface area of the gauge region 106 in contact with the formation material remains minimal and substantially constant. While the surface area of the gauge region 106 subsequently increases at greater bit tilt angles, the surface area of the gauge region 106 in contact with the formation material may remain less than the surface area of the gauge region 20 in contact with the formation until the bit tilt angle is sufficiently high that substantially all of the surface area of the gauge region 106 is in contact with the formation.

Further, the surface area of outer surfaces of the blade 104 in the transition region 120 and the recessed region 116 may be selectively controlled such that as the bit tilt angle increases with applications of moderate lateral forces and/or high lateral forces as previously described with regard to the linear region and cap region of the line 128 of FIG. 5A, the rate at which additional surface area of the gauge region 106 engages the sidewall of the borehole may be controlled as a function of bit tilt angle of the bit 100. Accordingly, in addition to the surface area of the radially outermost surface 118, one or more of the following may further be selectively tailored to control the slope of the linear region, or the rate at which the bit 100 side cuts the formation as the amount of lateral force and/or bit tilt angle increases: the inclusion, surface area, and/or shape of the transition region, the surface area and/or shape of recessed region, the distance d by which the recessed region is recessed from the radially outermost surface of the gauge feature, placement of the gauge feature relative to the top and bottom of the gauge region, and the cutting edge geometry of the gauge feature, as described and illustrated herein.

With regard to the surface area and/or shape of the transition region 120, in some embodiments, the transition region 120 may be tapered relative to the central axis 101 of bit 100 as illustrated in FIG. 4. In such embodiments, the surface area of the gauge region 106, including the gauge feature 112 and the transition region 120, in contact with the formation with increasing lateral forces increases constantly and gradually until the recessed region 116 contacts the formation. In other embodiments, the transition region 120 may be stepped so as to alternative between surface tapered relative to the central axis 101 and surfaces extending parallel to the central axis 101 as illustrated in FIG. 7. In such embodiments, the surface area of the gauge region 106, including the gauge feature 112 and the transition region 120, in contact with the formation with increasing lateral forces increases intermittently. In yet other embodiments described below, the gauge region may lack a transition region. In yet further embodiments described below, the gauge region may comprise one or more transition regions With regard to the cutting edge geometry of gauge region 106, the size and/or shape of the gauge features may be selected to adjust the aggressiveness with which the gauge region 106 side cuts the borehole sidewall. As used herein, the aggressiveness of the gauge region 106 refers to the relative volume of earth formation material being removed by the engagement of the gauge region 106 of the blade 104 with formation material on each rotation of the bit 100 as a function of force applied on the bit 100. Further, the size and/or shape of the gauge features may be selected to adjust the size of the insensitive region of the line 128 as previously explained with reference to FIG. 5A.

Figure 8:
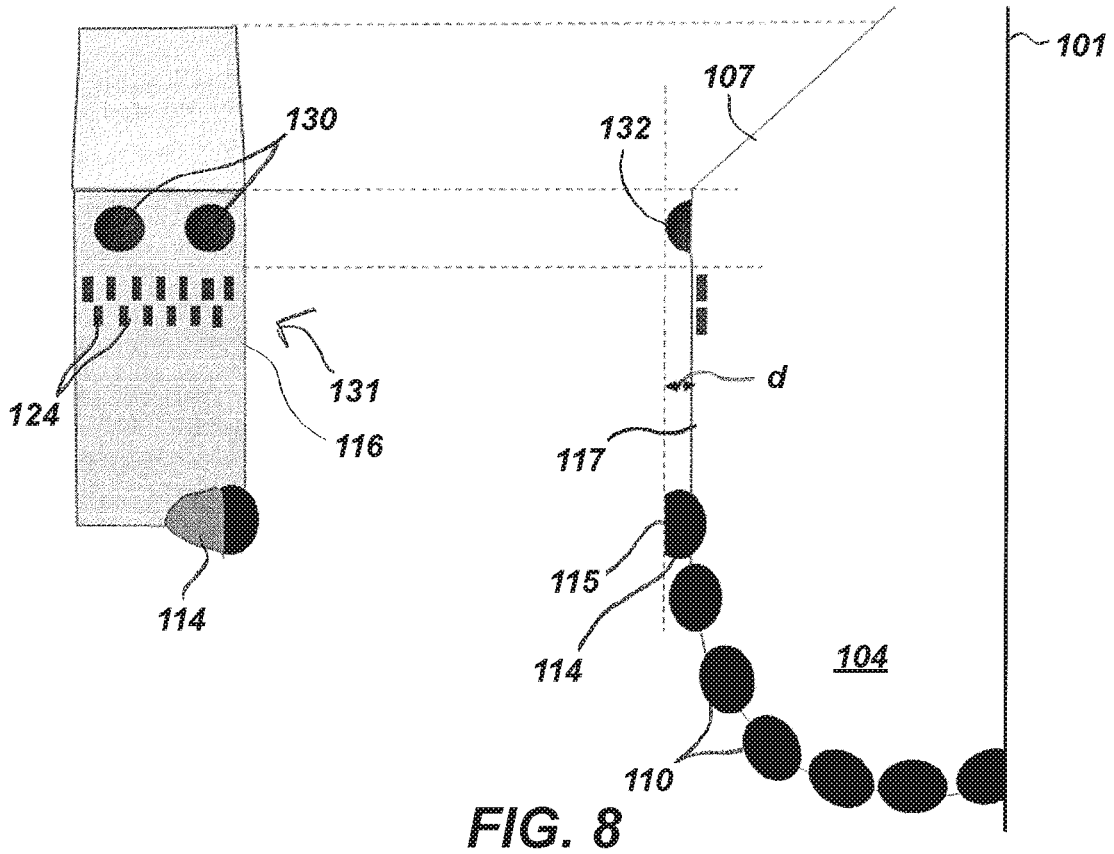

FIG. 8 illustrates a side view and corresponding profile view of a gauge region 131 including a gauge feature 130 according to embodiments of the present disclosure. The gauge feature 130 may comprise at least one dome-shaped or hemispherical-shaped feature that is known in the art as an "ovoid." Like the gauge feature 112 of FIG. 4, a radially outermost surface 132 of the gauge feature 130 may be coextensive with the linear cutting edge 115 of the gauge trimmers 114. Accordingly, the outermost surfaces 132, 118 of the gauge feature 130 and the gauge trimmers 114 may define the outer diameter of the drill bit 100. Unlike the gauge feature 112 of FIG. 4, the gauge region 131 may lack a transition region. Accordingly, the recessed region 116 may extend between the gauge feature 130 and the bottom of the gauge region 131.

Figure 9:
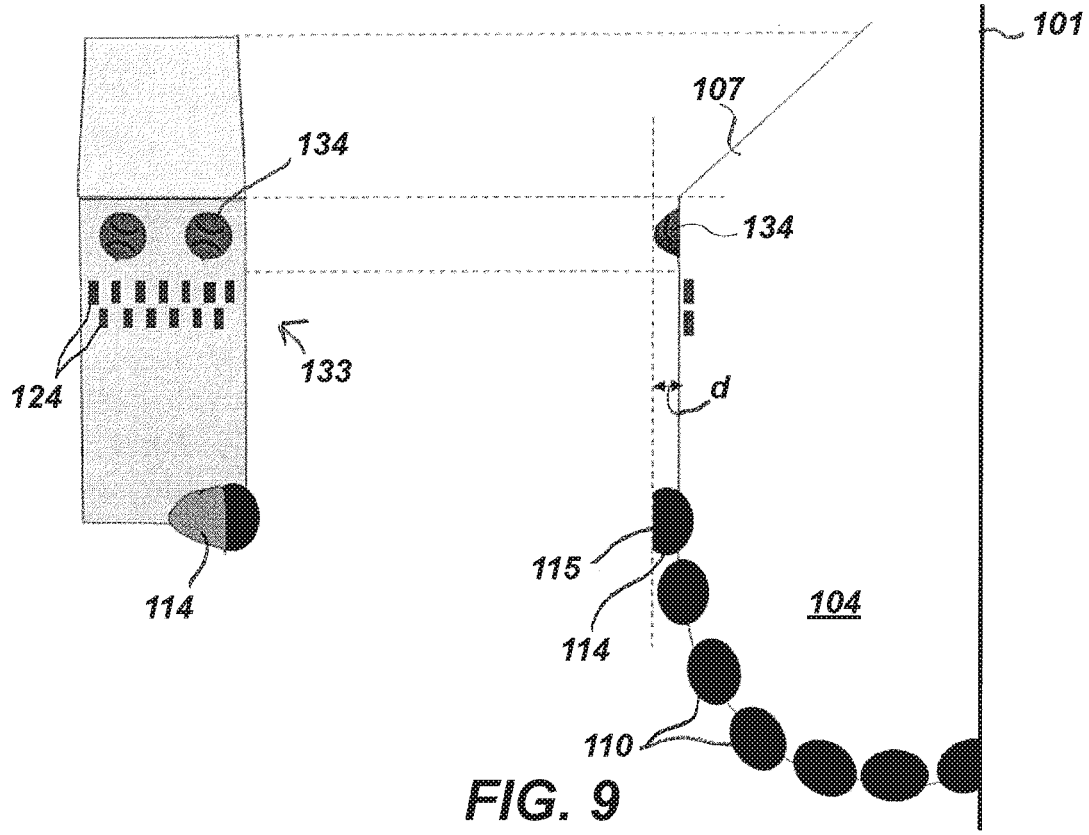

FIG. 9 illustrates a side view and corresponding profile view of the gauge region 133 including a gauge feature 134 according to embodiments of the present disclosure. In some embodiments, the gauge features 134 may comprise at least one chisel-shaped element. By way of example and not limitation, the chisel-shaped element may comprise Stay-True™ elements, developed and distributed by Baker Hughes, a GE company, LLC, assignee of the present invention. In other embodiments, the chisel-shaped elements may comprise chisel-shaped elements as described in U.S. Pat. No. 8,794,356, entitled "Shaped Cutting Elements on Drill Bits and Other Earth-Boring Tools, and Methods of Forming Same," issued Aug. 5, 2014, and/or in U.S. patent application Ser. No. 15/374,891, entitled "Cutting Elements, Earth-Boring Tools Including the Cutting Elements, and Methods of Forming the Cutting Elements," filed on Dec. 9, 2016, the entire disclosure of each of which is incorporated herein by this reference. Like the gauge region 131, the gauge region 133 may lack a transition region. Accordingly, the recessed region 116 may extend between the gauge feature 134 and the bottom of the gauge region 133.

Figure 10:
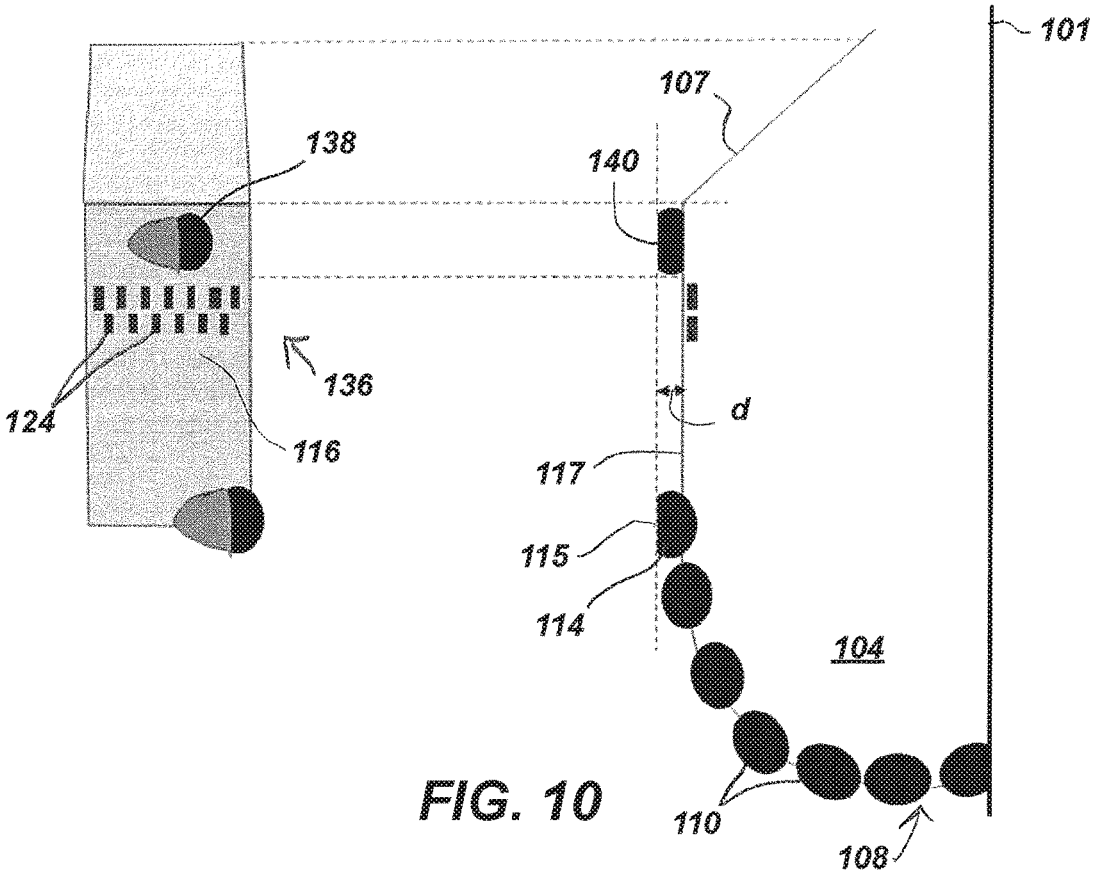

FIG. 10 illustrates a side view and corresponding profile view of a gauge region 136 including a gauge feature 138 according to embodiments of the present disclosure. The gauge feature 138 may comprise at least one semi-cylindrical or semi-disk-shaped cutting element such as the gauge trimmers 114. The gauge feature 138 may comprise a cutting element having a linear cutting edge 140. The linear cutting edge 140 may be formed by grinding, milling, or otherwise removing at least a portion of the sharp cutting edge formed at the intersection of a planar cutting face and a peripheral side surface of the polycrystalline table. In other embodiments, rather than employing a linear cutting edge of the cutting element as described in FIG. 10, the cutting face and thus the cutting edge of the cutting element may be arcuate, and the cutting element mounted on the gauge region 106 at a high back rake angle, such as a back rake angle between about 35° and about 75°, inclusive.

Figure 11:
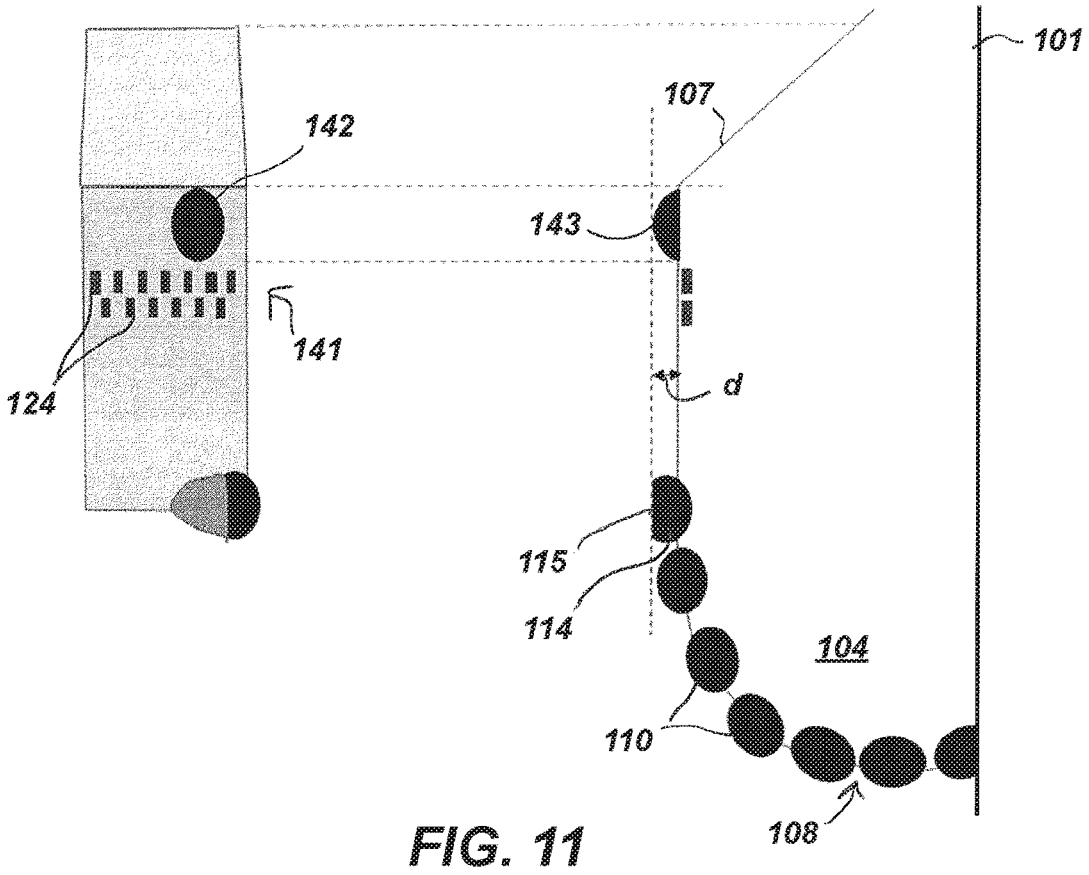

FIG. 11 illustrates a side view and corresponding profile view of a gauge region 141 including a gauge feature 142 according to further embodiments of the present disclosure. The gauge feature 142 may comprise at least one cylindrical or disk-shaped cutting element having a cutting edge 143 defined by multiple chamfers. The gauge feature 142 may comprise multiple chamfer cutting elements such as cutting elements described in U.S. Pat. No. 5,437,343, entitled "Diamond Cutters Having Modified Cutting Edge Geometry and Drill Bit Mounting Arrangement Therefor," issued Aug. 1, 1995, U.S. Pat. No. 6,935,444, entitled "Superabrasive Cutting Elements with Cutting Edge Geometry Having Enhanced Durability, Method of Producing Same, and Drill Bits So Equipped," issued Aug. 30, 2005, or U.S. Pat. No. 8,061,456, entitled "Chamfered Edge Gauge Cutters and Drill Bits So Equipped," issued Nov. 22, 2011, the entire disclosure of each of which is incorporated herein by this reference. In some embodiments, the multi-chamfer gauge feature 142 may be mounted on the blade 104 such that a larger chamfer of the gauge feature 142 defines the radially outermost surface of the gauge feature 142.

Figure 12:
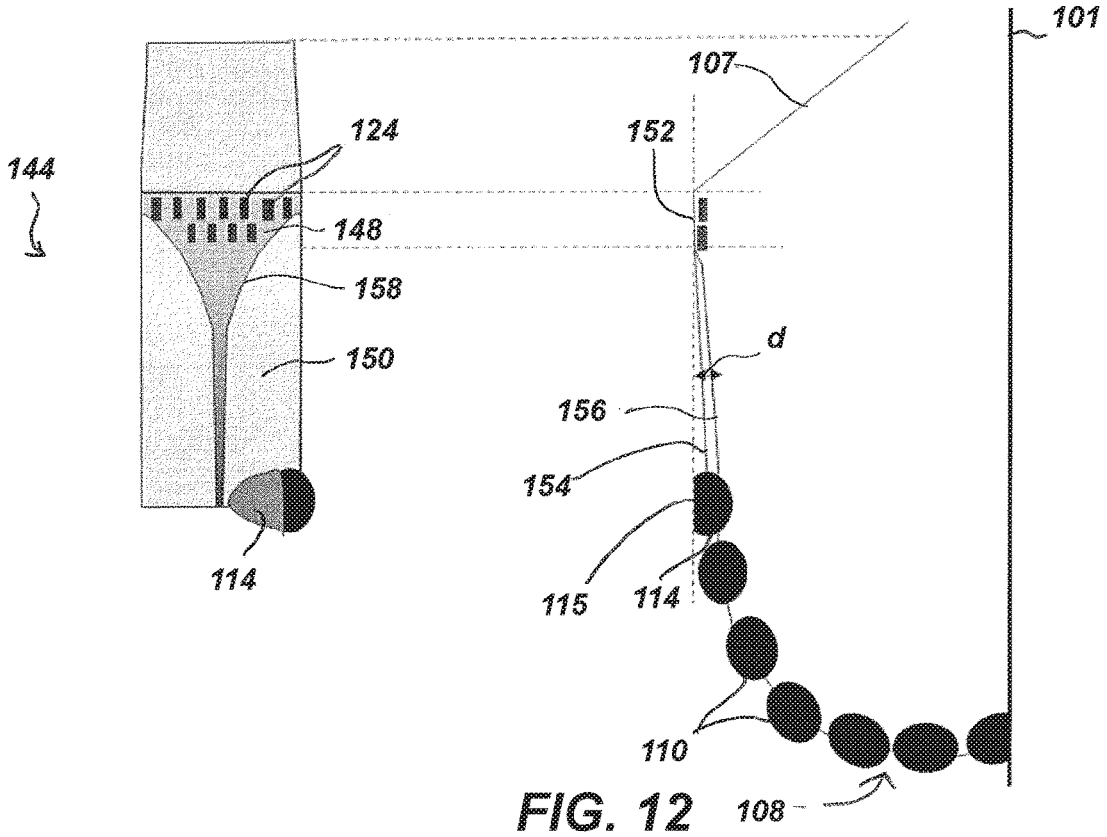

In each of the foregoing embodiments described with reference to FIGS. 3, 4, and 7-11, each of the radially outermost surface of the gauge feature and the outer surface of the blades 104 in the recessed regions may extend to substantially the same radial distance from the central axis 101 of the bit 100 between the leading and trailing edges of the blade 104. Further, in each of the foregoing embodiments described with reference to FIGS. 3, 4, and 7-11, the gauge features, transition regions, and/or recessed regions are located along the gauge region such that each forms a discrete region along the length of the gauge region. Put differently, the gauge features, transitions regions, and/or recessed regions may form axially adjacent regions but may not extend side-by-side axially along the length of the gauge region. However, the surfaces of and locations of the gauge features, transitions regions, and recessed regions are not so limited. As illustrated in the side and corresponding profile view of a gauge region 144 in FIG. 12, raised surfaces of a gauge feature 148 and relatively, recessed surfaces of a recessed region 150 may extend side-by-side axially at least partially along the length of the gauge region 144. Outer surfaces of the gauge feature 148 and/or within the recessed region 150 may extend at an angle relative to the central axis 101 of the bit 100.

In some embodiments, the gauge feature 148 may comprise a radially outermost surface 152 defining the full diameter of the bit. The gauge feature 148 may further comprise a raised surface 154 extending radially outward beyond a recessed surface 156 of the recessed region 150. As illustrated in the profile view of FIG. 12, the raised surface 154 and/or the recessed surface 156 may taper in height, which refers a dimension measured in a radial direction transverse to the central axis 101, as the gauge feature 148 and recessed region 150 extend along the length of the gauge region 144.

At the top of the gauge region 144, the gauge feature 148 may have a width coextensive with the width of the blade 104. The gauge feature 148 may taper in width as the gauge feature 148 extends along the length of the gauge region 144. Accordingly, the recessed region 150 may increase in width as the gauge feature 148 extends along the length of the gauge region 144. A boundary 158 between the gauge feature 148 and the recessed region 150 as the gauge feature 148 and the recessed region 150 extend side-by-side along the length of the gauge region 144 may be linear and/or curved.

In each of the foregoing embodiments described with reference to FIGS. 3, 4, and 7-12, the gauge features mounted on the bits have been provided at the top of the gauge region such that the gauge features are located adjacent to the crown chamfer 107 and distal from the face region 108 of the bit 100. However, the placement of the gauge features previously described herein is not so limited. For example, as illustrated in the perspective view of FIG. 13A and corresponding profile view of FIG. 13B, a gauge feature 160 may be located intermediately between the top and the bottom of a gauge region 162.

Figure 13A:
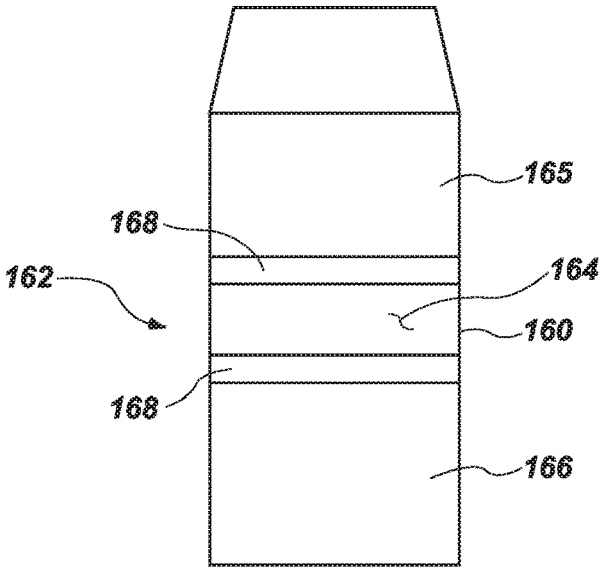
FIG. 13A-20B are corresponding profile views and perspective views of gauge regions according to yet other embodiments of the present disclosure.
Figure 13B:
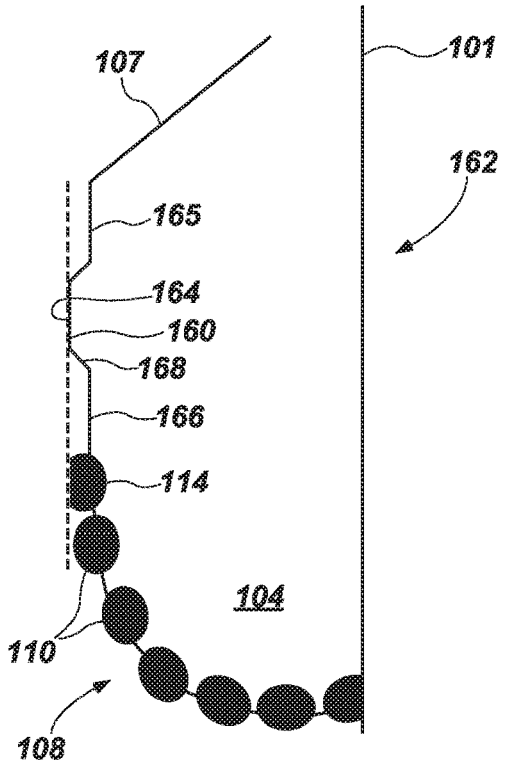

With continued reference to FIGS. 13A and 13B, the gauge feature 160 may comprise a radially outermost surface 164 of the bit and may be substantially similar to the gauge feature 112 previously described with reference to FIGS. 3 and 4. The gauge region 162 may further comprise upper and lower recessed regions 165, 166 located axially above and below the gauge feature 160, respectively. At illustrated in FIGS. 13A and 13B, the upper recessed region 165 may be located at the top of the gauge region 162 and the lower recessed region 166 may be located at the bottom of the gauge region 162.

The recessed regions 165, 166 may be substantial similar to the recessed region 116 previously described with reference to FIG. 4. As illustrated in the profile view of FIG. 13B, the upper and lower recessed regions 165, 166 may be recessed relative to the outermost surface 164 of the gauge feature 160. In some embodiments, the upper and lower recessed regions 165, 166 may be recessed relative to the outermost surface by substantially the same distance d. The gauge region 162 may further comprise a transition region 168 located between the gauge feature 160 and each of the recessed regions 165, 166. As illustrated in FIG. 13B, the transition region 168 may be substantially similar to the transition region 120 of FIG. 4. In other embodiments, the transition region 168 may be stepped as previously described with reference to FIG. 7. In yet other embodiments, such as previously described with reference to FIGS. 8 through 11, the gauge region 162 may lack a transition region.

Figure 14A:
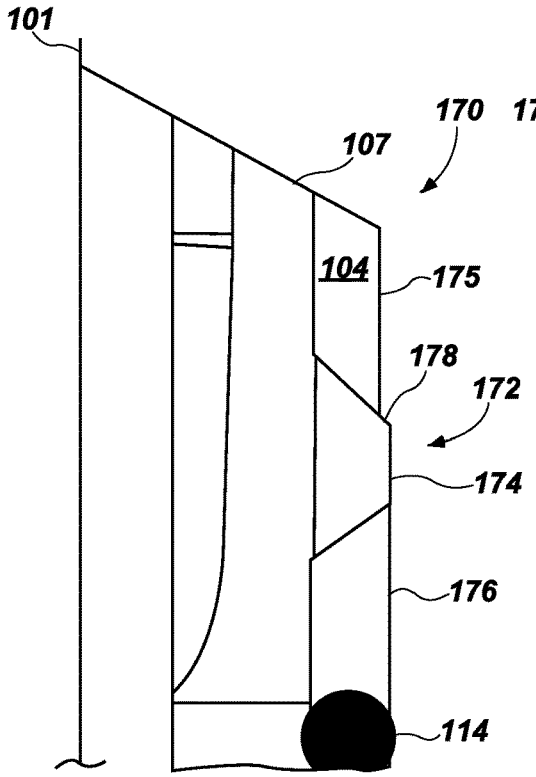
Figure 14B:
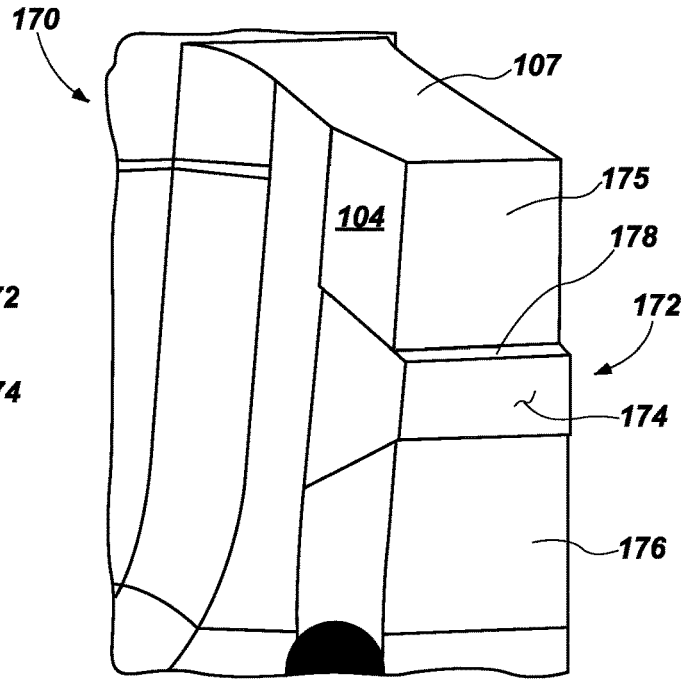

FIGS. 14A and 14B illustrate a gauge region 170 according to embodiments of the present disclosure. Similar to the gauge region 162 of FIG. 13, the gauge region 170 comprises a gauge feature 172 located intermediately between the top and the bottom of the gauge region 170. The gauge feature 172 may be substantially similar to the gauge feature 112 previously described with reference to FIGS. 3 and 4 such that the gauge feature 172 comprises a radially outermost surface 174 extending coextensively with the width of the blade 104. An upper recessed region 175 and a lower recessed region 176 may be located axially above and below the gauge feature 172, respectively. A transition region 178 may extend between one or more of the upper recessed region 175 and the lower recessed region 176. As illustrated in FIG. 14A, the transition region 178 may be tapered so as to provide a gradual change (e.g., reduction) in the radial extension of the blade 104 in the gauge region 170 between the gauge feature 172 and the upper recessed region 175. The lower recessed region 176 may be provided adjacent to the gauge feature 172 such that the gauge region 170 substantially lacks a transition region between the gauge feature 172 and the lower recessed region 176.

Figure 15A:
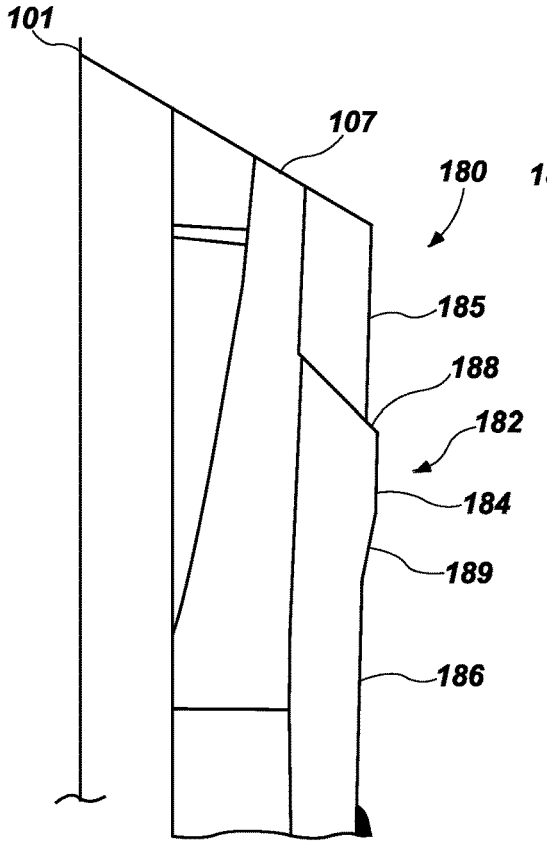
Figure 15B:
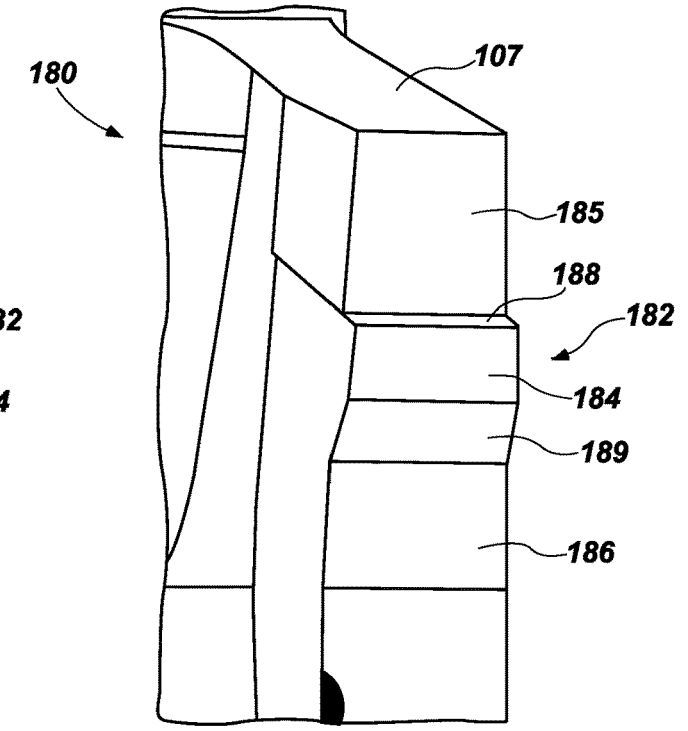

FIGS. 15A and 15B illustrate a gauge region 180 comprising a gauge feature 182 according to embodiments of the present disclosure. The gauge feature 182 may be located intermediately between the top and the bottom of the gauge region 180. The gauge feature 182 may be substantially similar to the gauge feature 112 previously described with reference to FIGS. 3 and 4 such that the gauge feature 182 comprises a radially outermost surface 184 extending coextensively with the width of the blade 104. An upper recessed region 185 and a lower recessed region 186 may be located above and below the gauge feature 182, respectively. Transition regions 188, 189 may extend between each of the upper recessed region 185 and the lower recessed region 186 and the gauge feature 182, respectively. As illustrated in FIG. 15A, each transition region 188, 189 may be tapered so as to provide a gradual reduction in the radial extension of the blade 104 in the gauge region 180 between the gauge feature 182 and the upper recessed region 185 and between the gauge feature 182 and the lower recessed region 186. In some embodiments, each transition region 188, 189 may exhibit substantially the same taper as illustrated FIGS. 13A and 13B such that the radial extension of the blade 104 in the gauge region 180 decreases over substantially the same axial distance. In other embodiments and as illustrated in FIG. 14A, the transition region 188 between the gauge feature 182 and the upper recessed region 185 may provide a steeper taper than the transition region 189 between the gauge feature 182 and the lower recessed region 186.

As further illustrated in FIG. 15A, outer surfaces of the blade 104 in the recessed regions 185, 186 may extend at an angle relative to the central axis 101. Outer surface of the blade 104 in the upper recessed region 185 may taper outwardly (e.g., extend radially outwardly) between the transition region 188 and the top of the gauge region 180 such that the distance by which the outer surfaces of the blade 104 in the upper recessed region 185 may be recessed relative to the radially outermost surface 184 of the gauge feature 182 decreases between the transition region 188 and the top of the gauge region 180. Outer surface of the blade 104 in the lower recessed region 186 may taper inwardly (e.g., extend radially inwardly) between the transition region 189 and the bottom of the gauge region 180 such that the distance by which the outer surfaces of the blade 104 in the lower recessed region 186 may be recessed relative to the radially outermost surface 184 of the gauge feature 182 increases between the transition region 189 and the bottom of the gauge region 180.

Figure 16A:
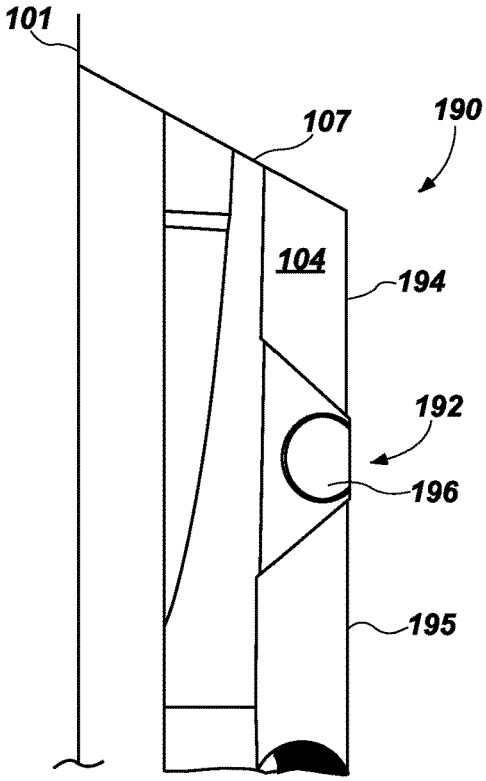
Figure 16B:
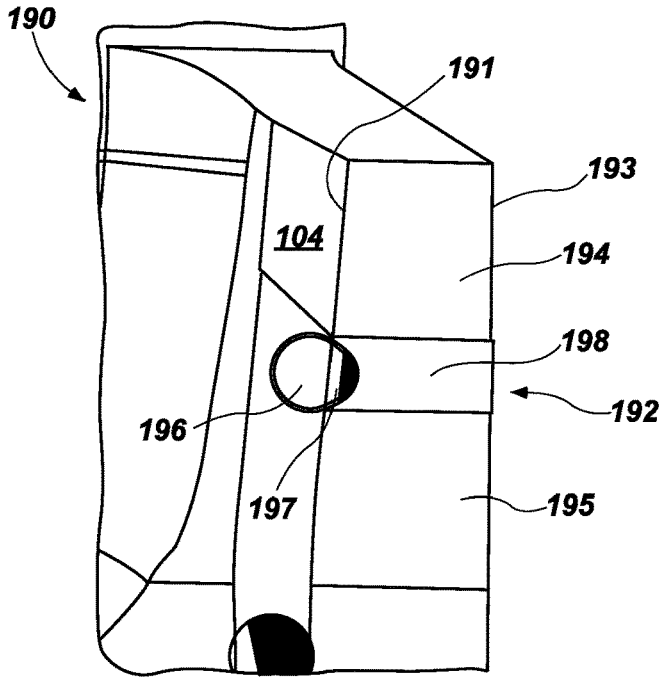

FIGS. 16A and 16B illustrate a gauge region 190 comprising a gauge feature 192 according to embodiments of the present disclosure. The gauge feature 192 may be located intermediately between the top and the bottom of the gauge region 190 and comprising upper and lower recessed regions 194, 195. The upper and lower recessed regions 194, 195 may be provided adjacent to the gauge feature 192 such that the gauge region 190 lacks a tapered region extending between the gauge feature 192 and respective recessed regions 194, 195. The gauge feature 192 may comprise a combination of two or more gauge features as previously described herein. The gauge feature 192 may be a combination of the gauge feature 160 substantially as described with reference to FIGS. 13A and 13B and the gauge feature 138 substantially as described with reference to FIG. 10. Accordingly, the gauge feature 192 may comprise a substantially blunt raised surface extending across the full width of the blade 104 such that the gauge feature 192 extends from a rotationally leading edge 191 and a rotationally trailing edge 193 of the blade 104 on which it is provided. In some embodiments, the gauge feature 192 may further comprise a cutting element 196 having a linear cutting edge 197. The linear cutting edge 197 may be coextensive with a radially outermost surface 198 of the gauge feature 192. The cutting element 196 may be located adjacent to the rotationally leading edge 191 of the blade 104. In other embodiments, the cutting element 196 may comprise a multiple chamfer cutting element as previously described with regard to the gauge feature 142 of FIG. 11. In yet other embodiments, the rotationally leading edge 191 of the blade 104 may be provided with an ovoid as previously described with regard to the gauge feature 130 of FIG. 8 or with a chisel-shaped element as previously described with regard to the gauge feature 134 of FIG. 9.

In some embodiments, the cutting element 196 may comprise a radially outermost surface that may be substantially radially coextensive with the radially outermost surface 198 of the gauge feature 192 such that the cutting element 196 does not extend radially beyond the radially outermost surface 198 of the gauge feature 192. In other embodiments, the radially outermost surface 198 of the cutting element 196 may be radially recessed relative to the radially outermost surface 198 of the gauge feature 192 or may extend radially beyond the radially outermost surface 198 of the gauge feature 192. The radially outermost surface of the cutting element 196 may be defined by the linear cutting edge 197 or one chamfer of a multi-chamfer cutting element.

Figure 17A:
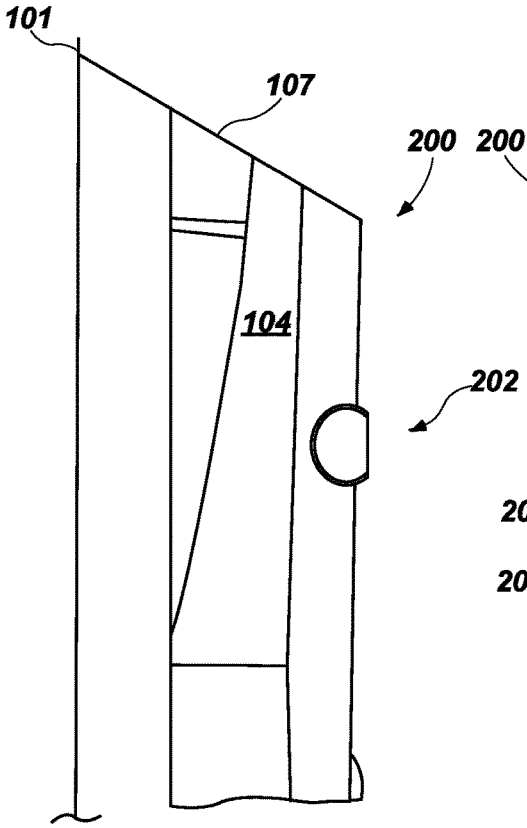
Figure 17B:
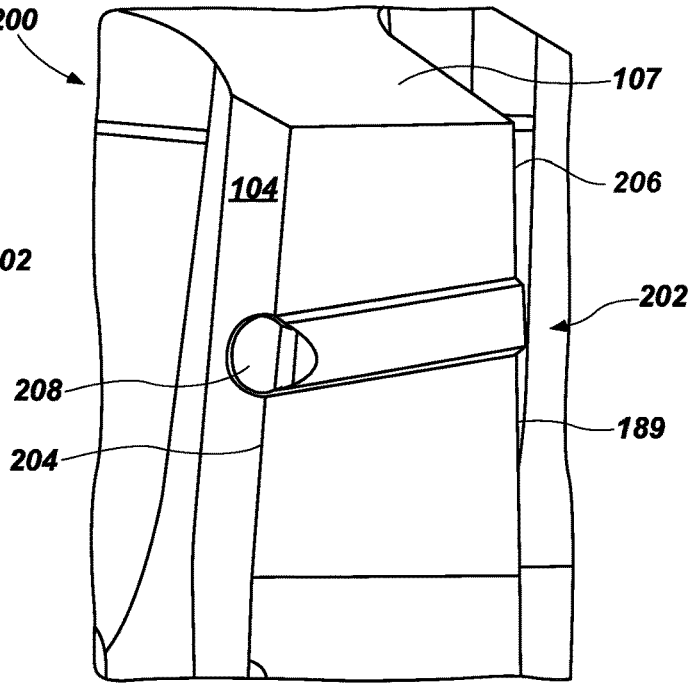

FIGS. 17A and 17B illustrate a gauge region 200 comprising a gauge feature 202 according to embodiments of the present disclosure. The gauge feature 202 may be located substantially intermediately between the top and the bottom of the gauge region 200. The gauge feature 202 may have a width substantially coextensive with a width of the blade 104 such that the gauge feature 202 extends from a rotationally leading edge 204 and a rotationally trailing edge 206 of the blade 104. The gauge feature 202 may extend helically as the gauge feature 202 extends circumferentially between the rotationally leading edge 204 and the rotationally trailing edge 206. The gauge feature 202 may comprise a cutting element 208 provided adjacent the rotationally leading edge 204 of the blade 104. In some embodiments, the cutting element 208 may comprise a cutting element such as the cutting element forming the gauge feature 138 provided in the gauge region 136 of the embodiment of FIG. 10. In other embodiments, the cutting element 208 may comprise a multiple chamfer cutting element as previously described with regard to the gauge feature 142 of FIG. 11. In yet other embodiments, the rotationally leading edge 204 of the blade 104 may be provided with an ovoid as previously described with regard to the gauge feature 130 of FIG. 8 or with a chisel-shaped element as previously described with regard to the gauge feature 134 of FIG. 9.

Figure 18A:
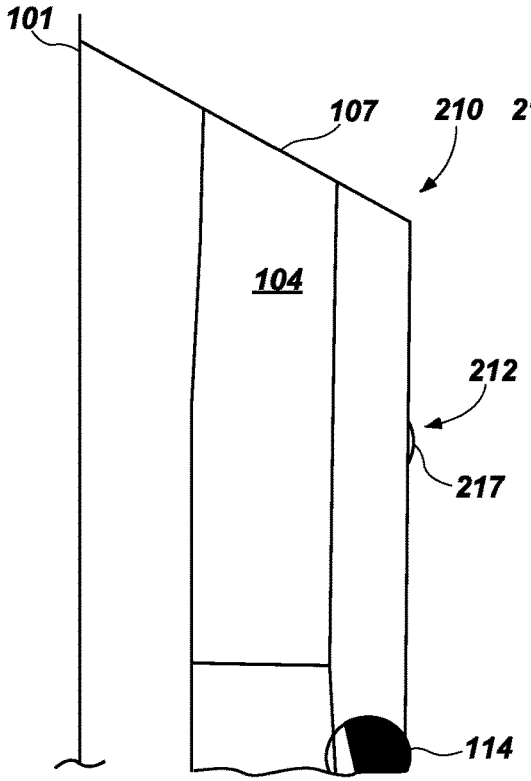
Figure 18B:
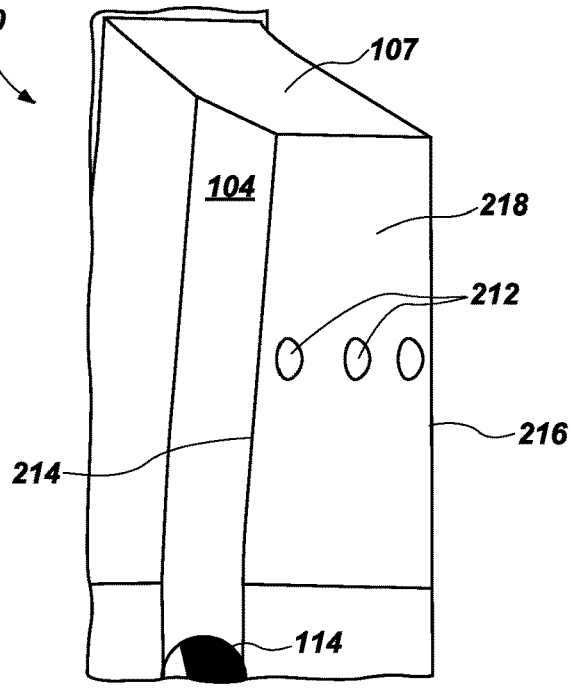

FIGS. 18A and 18B illustrate a gauge region 210 that may comprise at least one gauge feature 212 according to embodiments of the present disclosure. In some embodiments, the gauge region 210 may comprise a plurality of gauge features 212 extending between a rotationally leading edge 214 and a rotationally trailing edge 216 of the blade 104. The gauge features 212 may be located intermediately between the top and bottom of the gauge region 210. The gauge features 212 may comprise dome-shaped or hemispherical-shaped features known in the art as "ovoids," as previously described herein with regard to the gauge feature 130 of FIG. 8. Outermost surfaces 217 of the gauge features 212 may extend radially beyond outer surfaces of the blade 104 in a recessed region 218, which may define a majority of a surface area of the gauge region 210.

Figure 19A:
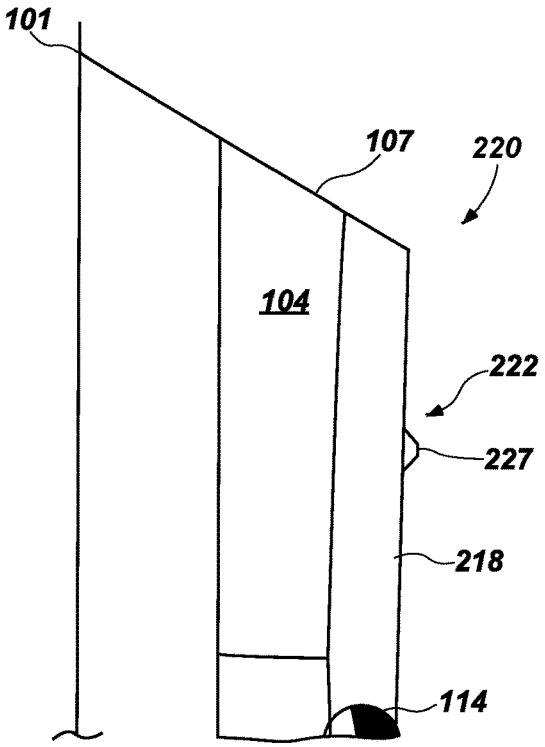
Figure 19B:
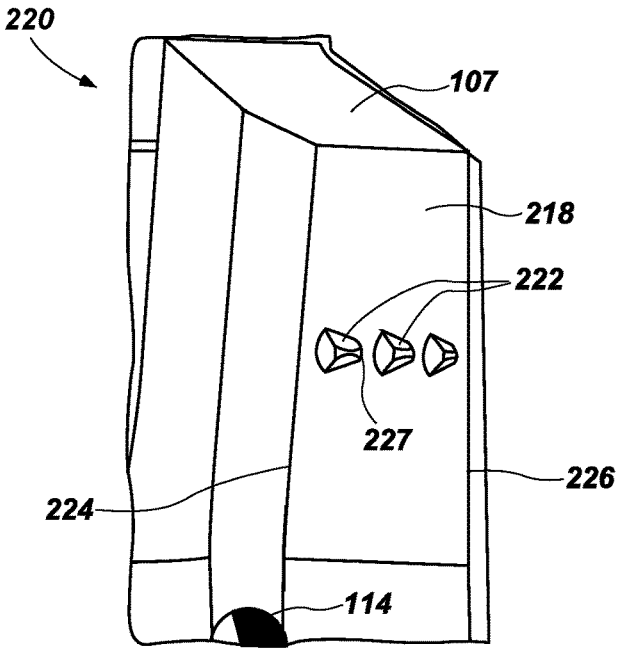

FIGS. 19A and 19B illustrate a gauge region 220 that may comprise at least one gauge feature 222 according to embodiments of the present disclosure. In some embodiments, the gauge region 220 may comprise a plurality of gauge features 222 extending between a rotationally leading edge 224 and a rotationally trailing edge 226 of the blade 104. The gauge features 222 may be located intermediately between the top and bottom of the gauge region 220. The gauge features 222 may comprise chisel-shaped features as previously described herein with regard to the gauge feature 134 of FIG. 9. Radially outermost surfaces 227 of the gauge feature 222 may extend radially beyond outer surface of the blade 104 in a recessed region 218, which may define a majority of a surface area of the gauge region 220.

Figure 20A:
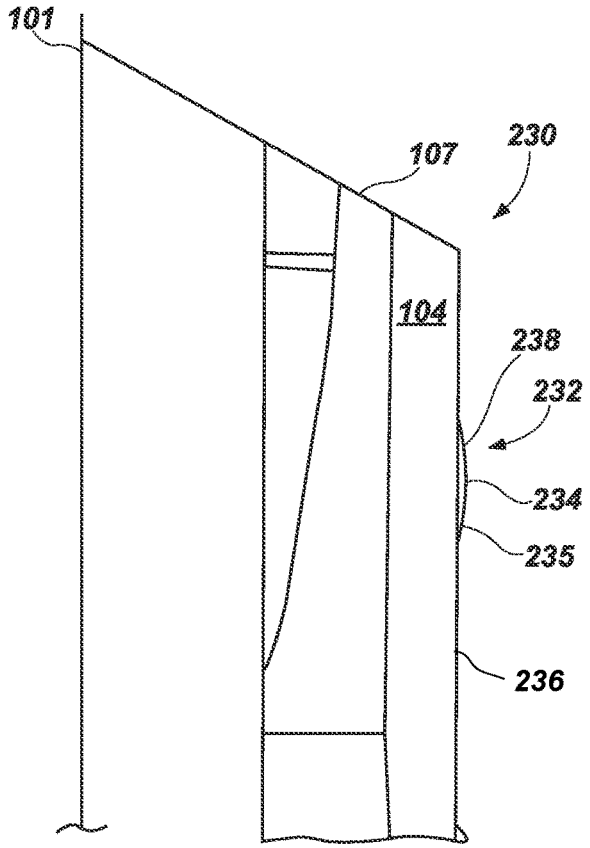
Figure 20B:
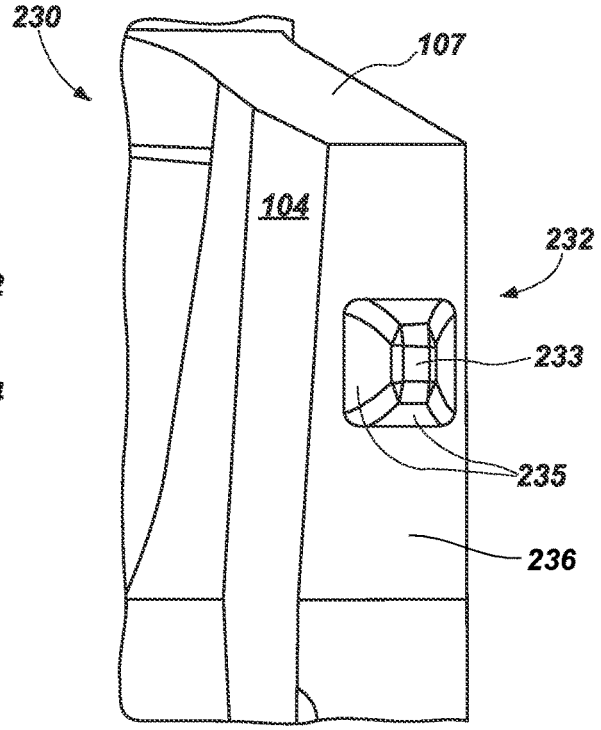

FIGS. 20A and 20B illustrate a gauge region 230 that may comprise a gauge feature 232 having a pyramidal shape. In some embodiments, the gauge feature 232 may have a square-pyramidal shape. The gauge feature 232 may comprise a frustum 233 defining a radially outermost surface 234 of the gauge feature 232 extending over a recessed region 236 of the gauge region 230. Faces 235 of the pyramidal gauge feature 232 may collectively define a transition region 238 of the gauge region 230. In some embodiments, the recessed region 236 may be provided adjacent to each face 235 of the gauge feature 232 such that the recessed region 236 may extending above, below, and/or alongside the gauge feature 232. As illustrated in FIG. 20B, edges of the pyramid-shaped gauge feature 232 may be rounded between adjacent faces 235 and between the frustum 233 and each face 235.

Figure 21:
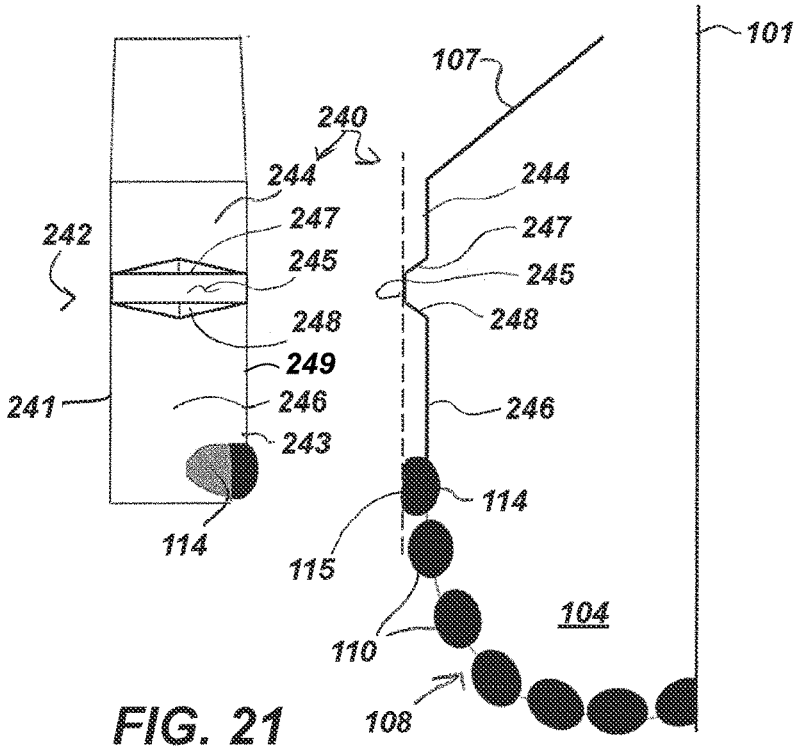
FIGS. 21-23 and 25 are corresponding side views and profile views of gauge regions according to further embodiments of the present disclosure.

FIG. 21 illustrates a corresponding side view and profile view of a gauge region 240 comprising at least one gauge feature 242. The gauge feature 242 may be located intermediately between the top and the bottom of the gauge region 240. A radially outermost surface 245 of the gauge feature 242 may be substantially rectangular in shape. The gauge region 240 may further comprise upper and lower recessed regions 244, 246 extending axially above and below the gauge feature 242, respectively. In some embodiments, upper and lower transition regions 247, 248 may extend between the outermost surface 245 of the gauge feature 242 and the upper and lower recessed regions 244, 246, respectively. As illustrated in FIG. 21, the transition regions 247, 248 may be substantially v-shaped such that the upper and lower transition regions 247, 248 vary in length (e.g., dimension measured at least partially axially along the gauge region 240) as the transitions regions extending across the width of the blade 104. Put differently, the upper and lower transition regions 247, 248 may be shaped such that the taper varies between the rotationally leading edge 241 of the blade 104 and the rotationally trailing edge 249 of the blade 104. The upper and lower transition regions 247, 248 may have a maximum length at a location intermediately between the rotationally leading edge 241 and the rotationally trailing edge 243 of the blade 104.

Figure 22:
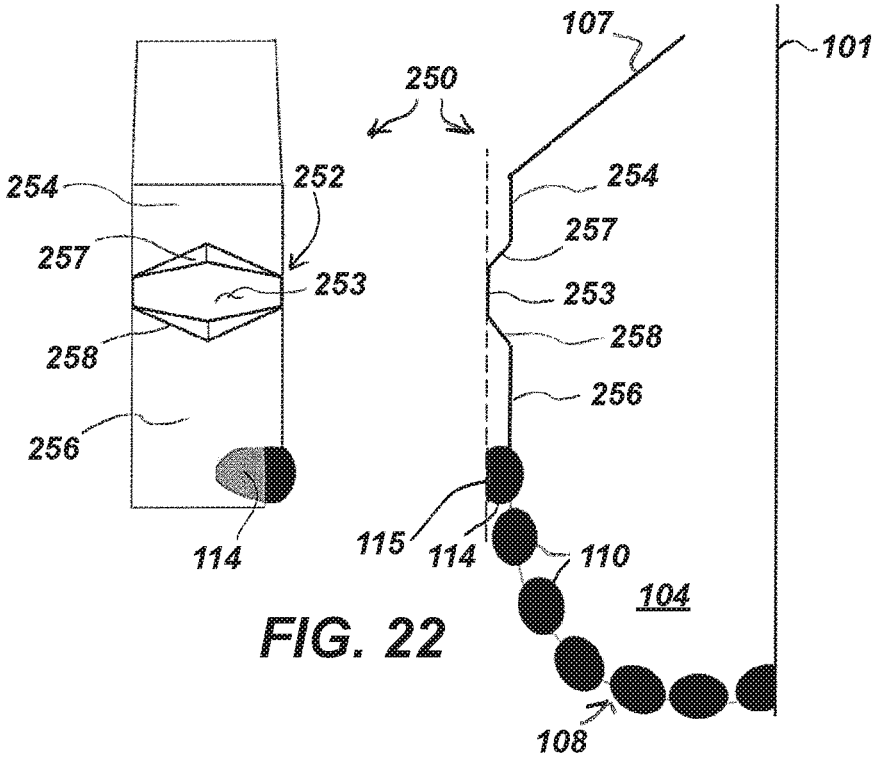

FIG. 22 illustrates a corresponding side view and profile view of a gauge region 250 comprising at least one gauge feature 252, upper and lower recessed regions 254, 256, and upper and lower transition regions 257, 258. The gauge feature 252, the upper and lower recessed regions 254, 256, and the upper and lower transition regions 257, 258 may be substantially similar to the gauge feature 242, upper and lower recessed regions 244, 246, and the upper and lower transition regions 247, 248 of FIG. 21, respectively, except that a radially outermost surface 253 of the gauge feature 252 may be hexagonal in shape in a side view. In some embodiments, the outermost surface 253 may have an irregular hexagonal shape. In yet other embodiments, the outermost surface 253 may have a circular, oval, irregular polygonal, or regular polygonal shape.

Figure 23:
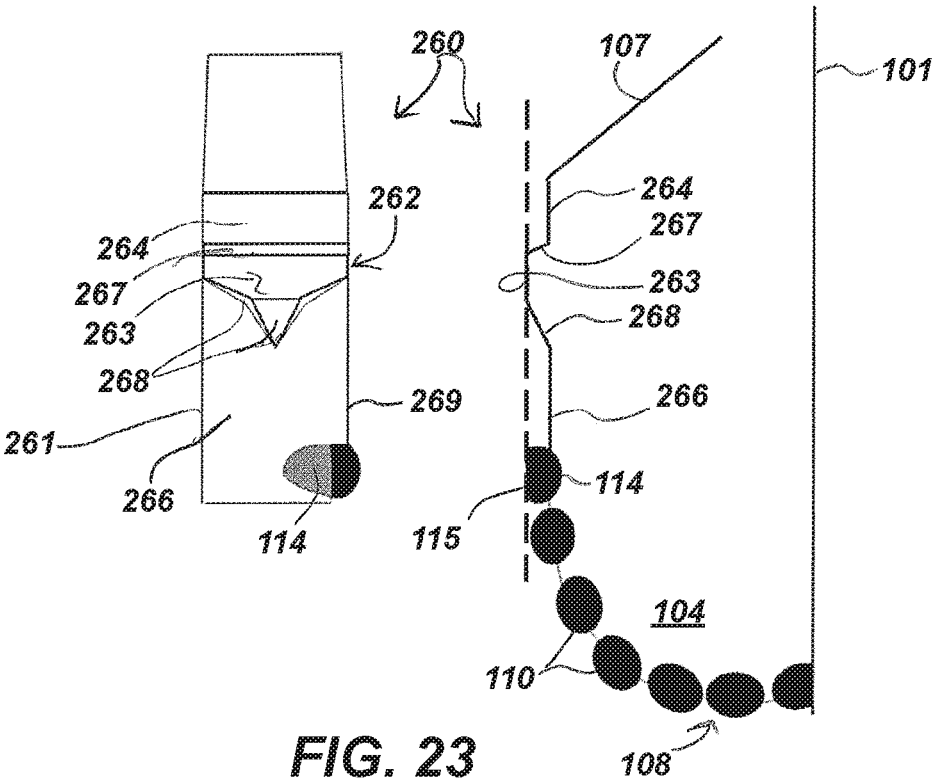

FIG. 23 illustrates a corresponding side view and profile view of a gauge region 260 comprising at least one gauge feature 262, upper and lower recessed regions 264, 266, and upper and lower transitions regions 267, 268. In side view, a radially outermost surface 263 of the gauge feature 262 may be hexagonal in shape. In some embodiments, the outermost surface 263 may have an irregular hexagonal shape. The upper and lower transitions regions 267, 268 may have different tapers. As illustrated in FIG. 23, the upper transition region 267 may have a steeper taper relative to the taper of the lower transition region 268. In some embodiments, the upper transition region 267 may provide a gradual change in radial extension of outer surfaces of the blade 104 between the gauge feature 262 and the upper transition region 267. The upper transition region 267 may be shaped such that the taper may be substantially constant between gauge feature 262 and the upper recessed region 254 and may not vary between the rotationally leading edge 261 of the blade 104 and the rotationally trailing edge 269 of the blade 104. The lower transition region 268 may be shaped such that the taper varies between the rotationally leading edge 261 of the blade 104 and the rotationally trailing edge 269 of the blade 104 as previously described with reference to the transition regions of FIG. 21.

Figure 24:
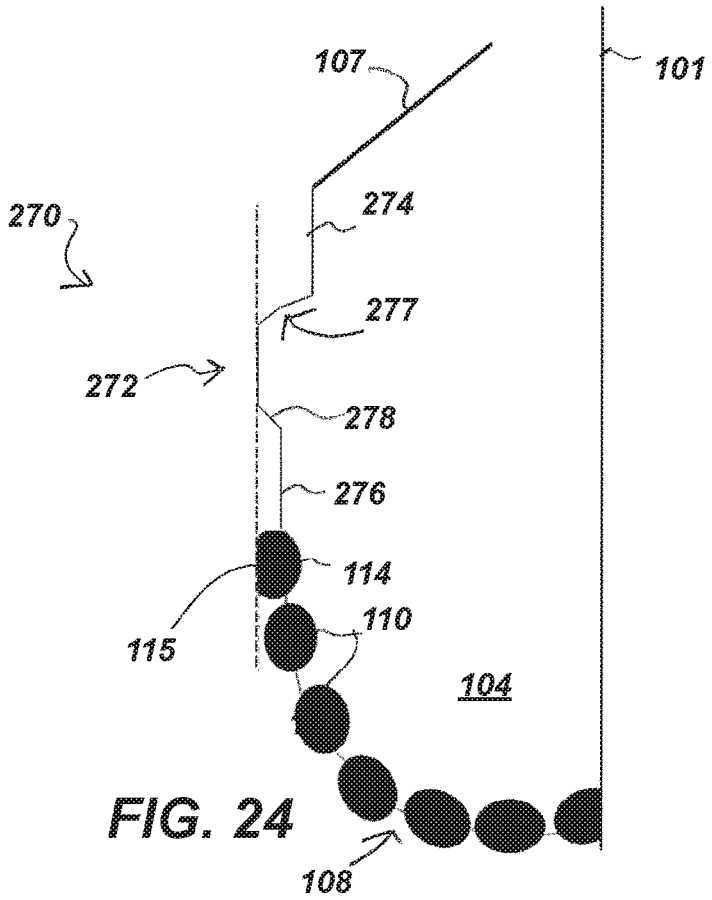
FIGS. 24, 26, and 27 are profile views of gauge regions according to the present disclosure.

While transition regions of gauge regions previously described here may have been described or illustrated as having a constant taper, the taper of the transition regions is not so limited. As illustrated in FIG. 24, gauge regions according to any of the embodiments previously described herein may comprise at least one transition region have a varied taper. The gauge region 270 illustrated in FIG. 24 comprises a gauge feature 272, upper and lower recessed regions 274, 276, and upper and lower transition regions 277, 278. At least one of the upper transition region 277 and the lower transition region 278 may have a first taper and a second taper different from the first taper. In some embodiments, the second taper may be steeper than the first taper as illustrated with regard to the upper transition region 277 in FIG. 24. In other embodiments, the first taper may be steeper than the second taper.

Figure 25:
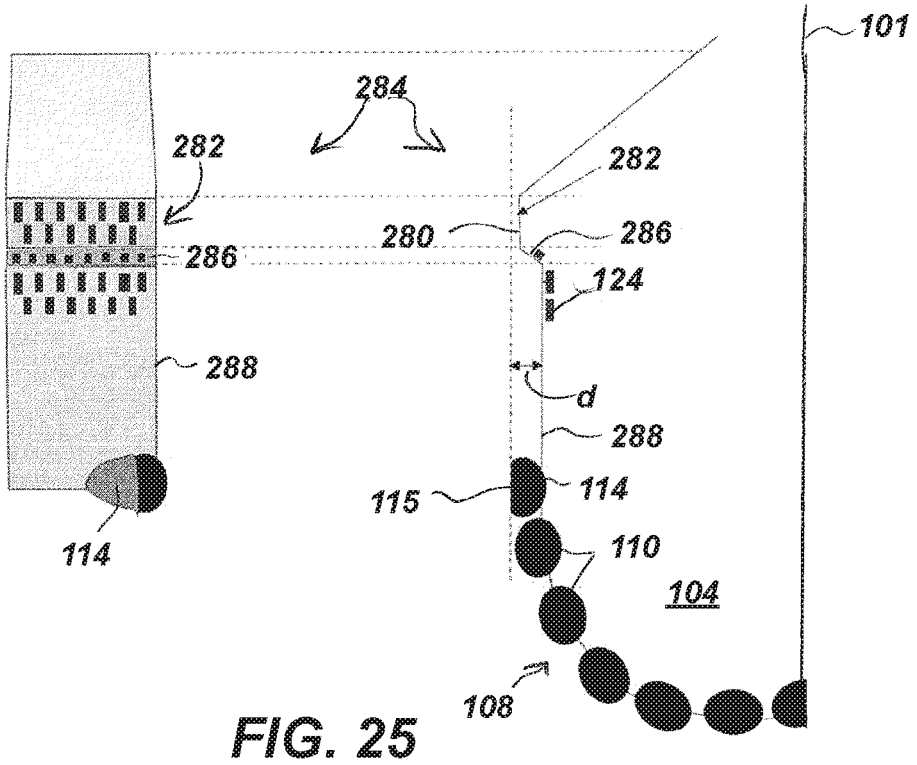

While radially outer surfaces of gauge features previously described herein may have been described as defining or as extending to the outer diameter of the bit 100, the radial extension of the radially outermost surfaces of the gauge features previously described herein is not so limited. In some embodiments, the radially outer surfaces of gauge features as described herein may be radially recessed relative to the outer diameter of the bit 100. As illustrated in FIG. 25, an outer surface 280 of a gauge feature 282 in a gauge region 284 may be radially recessed relative to the outer diameter of the bit 100 defined by the linear cutting edge 115 of the gauge trimmer 114 and may extend radially beyond outer surfaces of the blade 104 in a transition region 286 and a recessed region 288.

Figure 26:
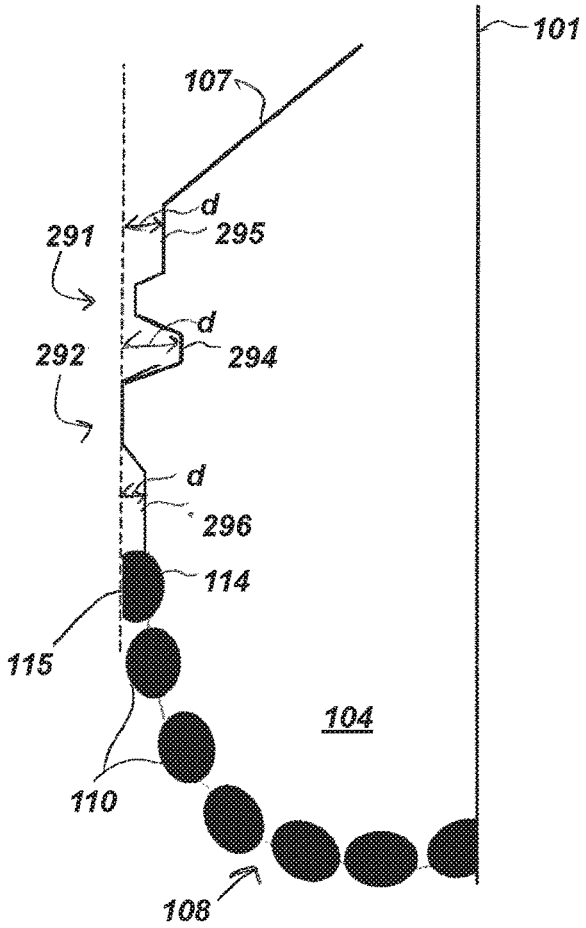
Figure 27:
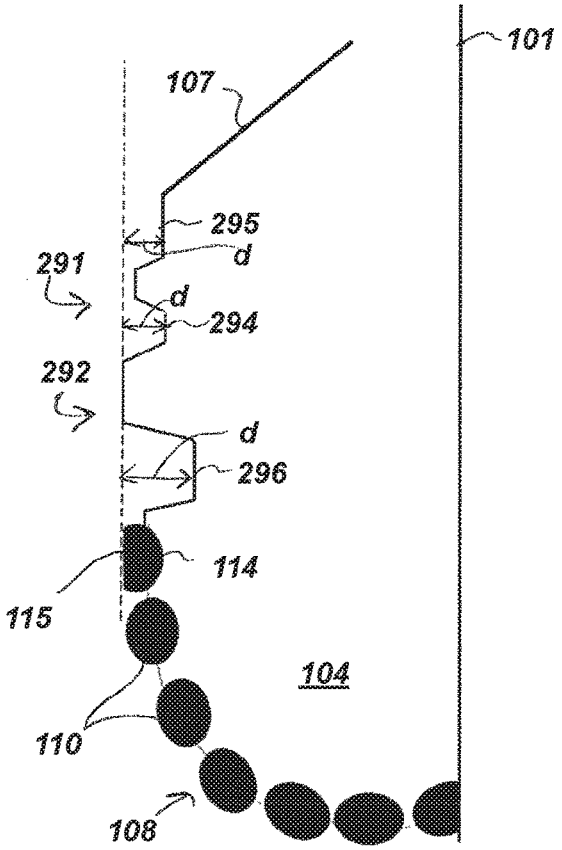

While gauge features of gauge regions previously described herein may have been previously described such that the gauge regions comprise a single gauge feature, the gauge regions as previously described herein are not so limited. As illustrated in FIGS. 26 and 27, a gauge region may have a plurality of gauge features 291, 292 axially spaced apart from each other and provided on a common blade 104. In some embodiments, a first recessed region 294 may extend between the gauge features 291, 292, a upper recessed region 295 may extend axially above the gauge feature 291, and a lower recessed region 296 may extend axially below the gauge feature 292. In some embodiments, at least one of the first recessed region 294, the upper recessed region 295, and the lower recessed region 296 may be recessed relative to an outer surface 293 of the gauge feature 291 may substantially the same distance, as illustrated in FIG. 27. In other embodiments, at least one of the first recessed region 294, the upper recessed region 295, and the lower recessed region 296 may be recessed relative to the outer surface of the gauge feature 291 by different distances, as illustrated in FIG. 26. In yet other embodiments, each of the first recessed region 294, the upper recessed region 295, and the lower recessed region 296 may be recessed relative to the outer surface of the gauge feature 291 by a different distance. Accordingly, gauge features according to one or more of any of the foregoing embodiments may be provided on a common blade 104.

Figure 28A:
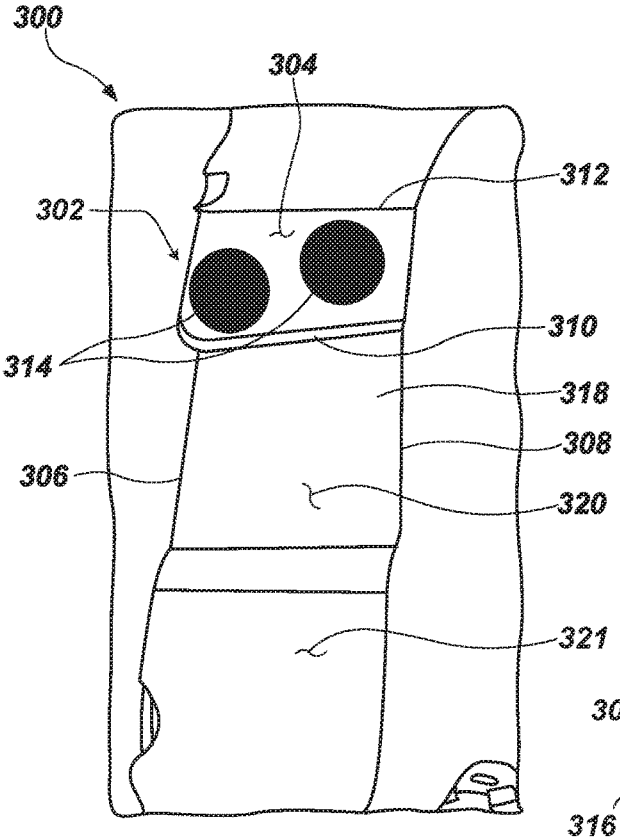
FIGS. 28A-29B are corresponding profile views and side views of gauge regions according to embodiments of the present disclosure.
Figure 28B:
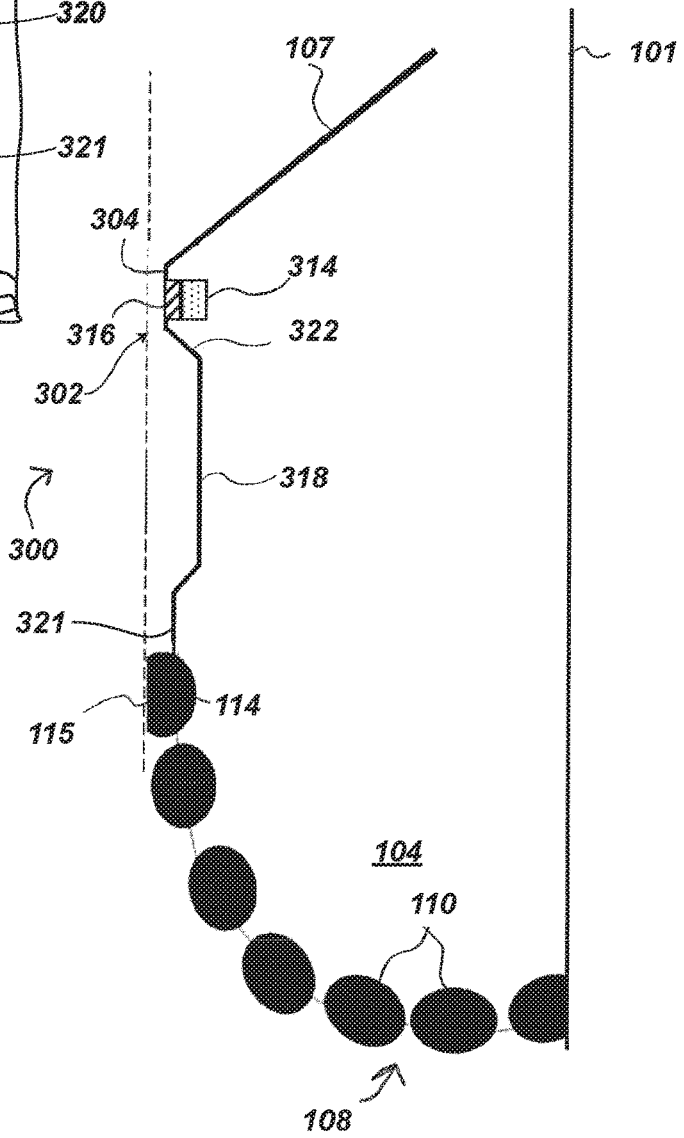

FIGS. 28A and 28B illustrate a gauge region 300 comprising a gauge feature 302 located at a top of the gauge region 300 adjacent to the crown chamfer 107. The gauge feature 302 may comprise a substantially blunt radially outermost surface 304 extending from a rotationally leading edge 306 to a rotationally trailing edge 308 of the blade 104. A radial extension of the gauge feature 302 (e.g., a radial distance that the outermost surface 304 extends relative to the central axis 101) is substantially constant as the gauge feature 302 extends between the rotationally leading edge 306 and the rotationally trailing edge 308. In some embodiments, a radial extension of the gauge feature 302 may be substantially coextensive with the radial extension of the bit 100 including the gauge region 300. In other words, the radially outermost surface 304 is coextensive with an outer diameter of the bit 100. In other embodiments, the outermost surface 304 may be recessed relative to the bit 100 diameter by a radial distance in a range extending from about 0.005 inch (0.127 mm) to about 0.020 inch (0.508 mm), from about 0.005 inch (0.127 mm) to about 0.010 inch (0.254 mm), and more particularly may be about 0.010 inch (0.254 mm) or about 0.005 inch (0.127 mm).

The gauge feature 302 may taper in length as the gauge feature 302 extends circumferentially between the rotationally leading edge 306 and the rotationally trailing edge 308 of the blade 104. As illustrated in FIG. 28A, the gauge feature 302 may be tapered such that a downhole edge 310 of the gauge feature 302 inclines toward an uphole edge 312 as the gauge feature 302 extends circumferentially between the rotationally leading edge 306 and the rotationally trailing edge 308. The uphole edge 312 of the gauge feature 302 may be substantially straight (e.g., planar) as the gauge feature 302 extends circumferentially between the rotationally leading edge 306 and the rotationally trailing edge 308.

At least one cutting element 314 may be mounted on the gauge feature 302. In some embodiments, the gauge feature 302 may include two cutting elements 314. One of the cutting elements 314 may be located proximate to the rotationally leading edge 306 while the other cutting element 314 may be located proximate to the rotationally trailing edge 308.

The cutting elements 314 may be mounted in pockets formed in the blade 104. The cutting elements 314 may be mounted at a high back rake angle such as a back rake angle in a range from about 85 degrees to about 90 degrees or from about 87 degrees to about 90 degrees. In some embodiments, the cutting elements 314 may be mounted in the pockets such that a radially outermost surface 316 thereof is substantially radially coextensive with the radially outermost surface 304 of the gauge feature 302. Put differently, the cutting elements 314 may be mounted in pockets such that the radially outermost surface 316 thereof (e.g., a cutting face) does not extend radially beyond the radially outermost surface 316 of the gauge feature 302. The cutting elements 314 may comprise polycrystalline diamond compact (PDC) cutting elements each including a volume of polycrystalline diamond material provided on a ceramic-metal composite material substrate.

In some embodiments, the cutting face of the cutting elements 314 may be substantially planar. In other embodiments, the cutting face of the cutting element 314 may include an arcuate (e.g., curved surface). In such embodiments, the cutting face may be ground such that the cutting face of the cutting element 312 has a curvature substantially the same as the curvature of the blade 104 in the gauge region 300.

The gauge region 300 may further comprise a recessed region 318 located axially below the gauge feature 302. An outer surface 320 of the blade 104 in the recessed region 318 may be recessed relative to the radially outermost surface 304 of the gauge feature 302 and to the outer diameter of the bit 100. The outer surface 320 may be recessed relative to the outer diameter of the bit 100 by a radial distance in a range extending from about 0.005 inch (0.127 mm) to about 0.360 inch (9.144 mm), from about 0.010 inch (0.254 mm) to about 0.180 inch (4.572 mm), or from about 0.030 inch (0.762 mm) to about 0.090 inch (4.572 mm) and, more particularly, by about 0.090 inch (2.286 mm).

A transition region 322 may extend axially and radially between the gauge feature 302 and the recessed region 318. In some embodiments, the transition region 322 may extend helically as the gauge feature 302 tapers in length as the gauge feature 302 extends circumferentially between the rotationally leading edge 306 and the rotationally trailing edge 308.

As best illustrated in the side cross-sectional view of the blade 104 in FIG. 28B, one or more (e.g., each) of the radially outermost surface 304 of the gauge feature 302, outer surfaces of the transition region 322, and the outer surface 320 in the recessed region may be recessed relative to the outer diameter of the bit 100, as indicated by the dashed line in FIG. 28B. In some embodiments, a surface 321 of the blade 104 adjacent the face 108 of the bit 100 (e.g., adjacent gage trimmers) may be recessed relative to the outer diameter of the bit 100. The surface 321 may be radially recessed relative to the outer diameter of the bit body 102 by a distance in a range extending from about 0.010 inch (0.254 mm) to about 0.030 inch (0.762 mm) and may be about 0.030 inch (0.762 mm) or about 0.015 inch (0.381 mm). Accordingly, substantially an entire outer surface of the blade 104 in the gauge region 300 is recessed relative to the outer diameter of the bit 100.

Figure 29A:
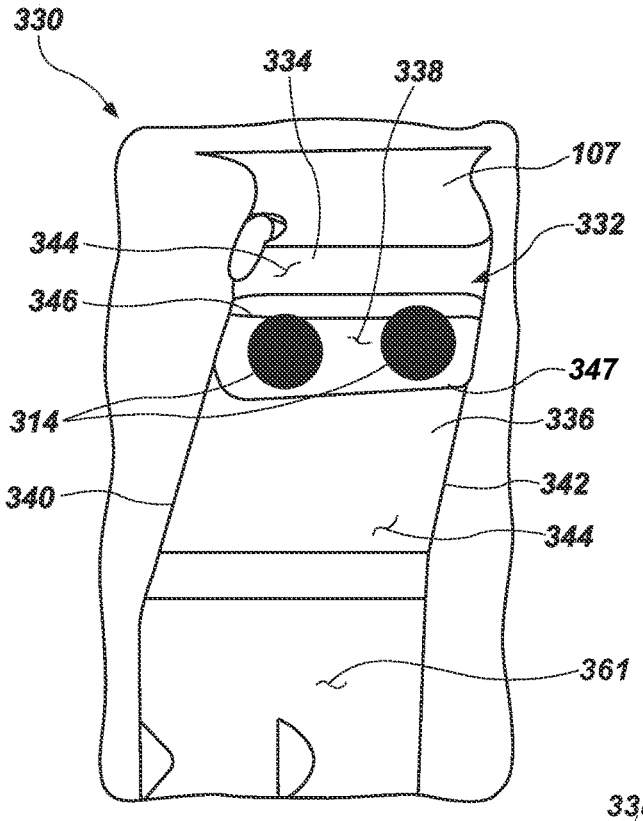
Figure 29B:
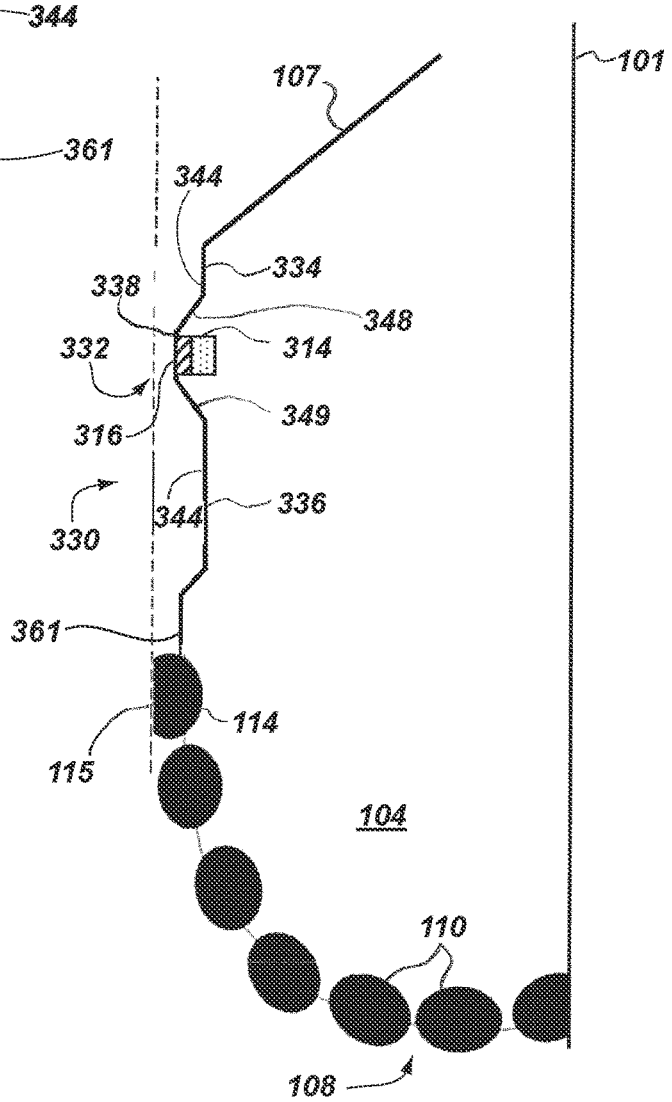

FIGS. 29A and 29B illustrate a gauge region 330 comprising a gauge feature 332 substantially similar to the gauge feature 302 of FIGS. 28A and 28B. The gauge region 330 comprises the gauge feature 332 between a first recessed region 334 located axially above the gauge feature 332 and a second recessed region 336 located axially below the gauge feature 332. The first recessed region 334 may be located at the top of the gauge region 330 adjacent to the crown chamfer 107. The gauge feature 332 may comprise a substantially blunt radially outermost surface 338 extending from a rotationally leading edge 340 to a rotationally trailing edge 342 of the blade 104. A radial extension of the gauge feature 332 is substantially constant as the gauge feature 332 extends between the rotationally leading edge 340 and the rotationally trailing edge 342. In some embodiments, the outermost surface 338 is coextensive with an outer diameter of the bit 100. In other embodiments, the outermost surface 338 may be recessed relative to the bit 100 diameter by a radial distance in a range extending from about 0.005 inch (0.127 mm) to about 0.020 inch (0.508 mm), from about 0.005 inch (0.127 mm) to about 0.010 inch (0.254 mm), and more particularly may be about 0.010 inch (0.254 mm) or about 0.005 inch (0.127 mm).

The gauge feature 332 may taper in length as the gauge feature 332 extends circumferentially between the rotationally leading edge 340 and the rotationally trailing edge 342 of the blade 104. As illustrated in FIG. 29A, the gauge feature 332 may be tapered such that a downhole edge 347 of the gauge feature 332 inclines toward an uphole edge 346 as the gauge feature 332 extends circumferentially between the rotationally leading edge 340 and the rotationally trailing edge 342. The uphole edge 346 of the gauge feature 332 may be substantially straight (e.g., planar) as the gauge feature 332 extends circumferentially between the rotationally leading edge 340 and the rotationally trailing edge 342.

The gauge feature 332 may have cutting elements 314 mounted therein as described with reference to FIGS. 28A and 28B. An outer surface 344 of the blade 104 in the first and second recessed regions 334, 336 may be recessed relative to the radially outermost surface 338 of the gauge feature 332. The first and second recessed regions 334, 336 may be recessed relative to the radially outermost surface 338 of the gauge feature 332 by substantially the same distance or by a different distance as previously described with reference to FIGS. 13A and 13B. The outer surface 344 may be recessed relative to the outer diameter of the bit 100 by a radial distance in a range extending from about 0.005 inch (0.127 mm) to about 0.360 inch (9.144 mm), from about 0.010 inch (0.254 mm) to about 0.180 inch (4.572 mm), or from about 0.030 inch (0.762 mm) to about 0.090 inch (4.572 mm) and, more particularly, by about 0.090 inch (2.286 mm). In some embodiments, the first recessed region 334 and the second recessed region 336 may be recessed relative to the radially outermost surface 338 of the gauge feature 332 by different distances or by the same distance.

A first transition region 348 may extend axially and radially between the gauge feature 332 and the first recessed region 334, and a second transition region 349 may extend axially and radially the gauge feature 332 and the second recessed region 336. In some embodiments, the second transition region 349 may extend helically and the first transition region 348 may extend substantially straight as the gauge feature 332 tapers in length as the gauge feature 332 extends circumferentially between the rotationally leading edge 340 and the rotationally trailing edge 342.

As best illustrated in the side cross-sectional view of the blade 104 in FIG. 29B, one or more (e.g., each) of the radially outermost surface 338 of the gauge feature 332, outer surfaces of the first and second transition regions 348, 349, and the outer surface 344 in the recessed regions 334, 336 may be recessed relative to the outer diameter of the bit 100, as indicated by the dashed line in FIG. 29B. In some embodiments, a surface 361 of the blade 104 adjacent the face 108 of the bit 100 (e.g., adjacent gage trimmers) may be recessed relative to the outer diameter of the bit 100. The surface 344 may be radially recessed relative to the outer diameter of the bit 100 by a distance in a range extending from about 0.010 inch (0.254 mm) to about 0.030 inch (0.762 mm) and may be about 0.030 inch (0.762 mm) or about 0.015 inch (0.381 mm). Accordingly, substantially an entire outer surface of the blade 104 in the gauge region 330 is recessed relative to the outer diameter of the bit 100.

Figure 30:
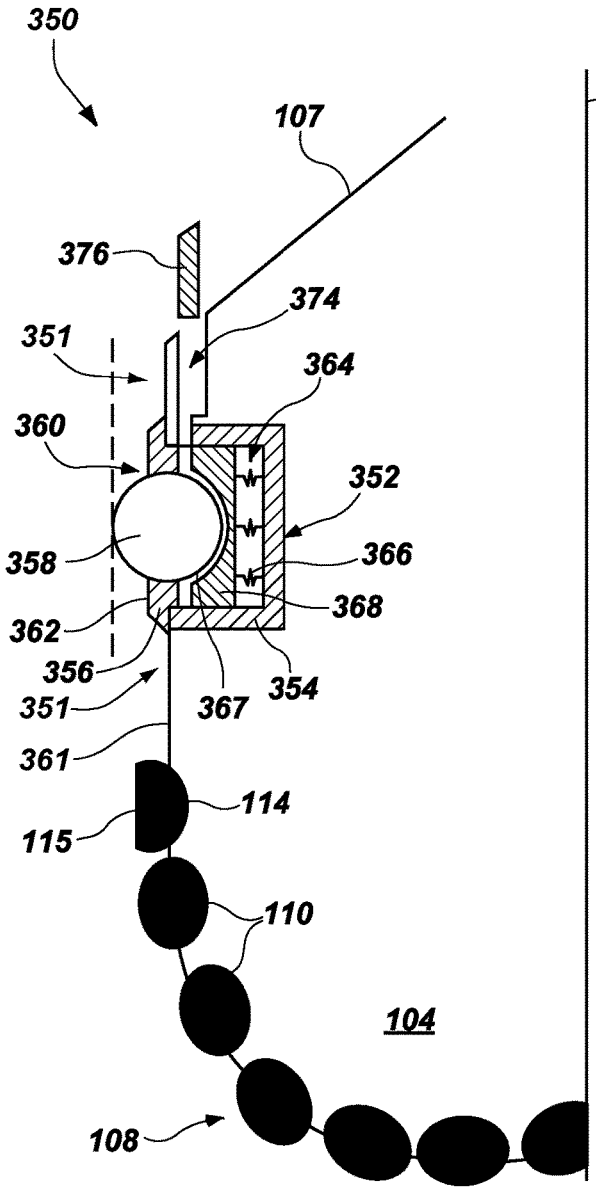
FIGS. 30 and 31 are illustrations of rotatable gauge features according to the present disclosure.

In the foregoing embodiments, the gauge features may be fixed to the blade 104 such that the gauge features are stationary. In such embodiments, the gauge features, the recessed regions, and/or the transition regions may be integrally formed with the bit body such that the gauge features, the recessed regions, and/or the transition regions form part of the blade 104 in the gauge region. In other embodiments, one or more elements of the gauge features may be separately formed and coupled to the blade 104. In yet further embodiments, one or more elements of the gauge features may be moveable. FIG. 30 illustrates an embodiment of a gauge region 350 comprising a rotatable gauge feature 352 mounted on the blade 104. Recessed regions 351 may be provided above and/or below the gauge feature 352 on the blade 104. The gauge feature 352 may be substantially similar to the rotatable bearing elements described in U.S. patent application Ser. No. 15/668,474, filed Aug. 3, 2017, entitled "Earth-Boring Tools Including Rotatable Bearing Elements and Related Methods," the entire disclosure of which is hereby incorporated herein by this reference. The gauge feature 352 may comprise a housing including a lower retaining member 354 and an upper retaining member 356. The lower and upper retaining members 354, 356 retain a rolling element 358 therein. In some embodiments, the rolling element 358 may comprise a spherical body or ball. The rolling element 358 may extend through an aperture 360 formed in the upper retaining member 356 and extend over an upper surface 362 of the upper retaining member 356. The upper surface 362 of the upper retaining member 356 may be provided with a wear-resistant material such as wear-resistant inserts 124 previously described herein to inhibit excessive wear of the blade 104 and the upper retaining member 356.

The lower retaining member 354 may comprise a cavity 364 in which a damping element 366 may be disposed. The damping element 366 may comprise one or more springs, a fluid, and/or an elastically deformable material such as rubber. The damping element 366 may be provided between a base of the cavity 364 and a support plate 368. The support plate 368 may comprise a recess 367 sized and shaped to abut against an outer surface of the rolling element 358 without hindering rotation thereof. The rolling element 358 may be rotatable about any of the three rotational axes such that the rolling element 358 exhibits three rotational degrees of freedom.

Figure 31:
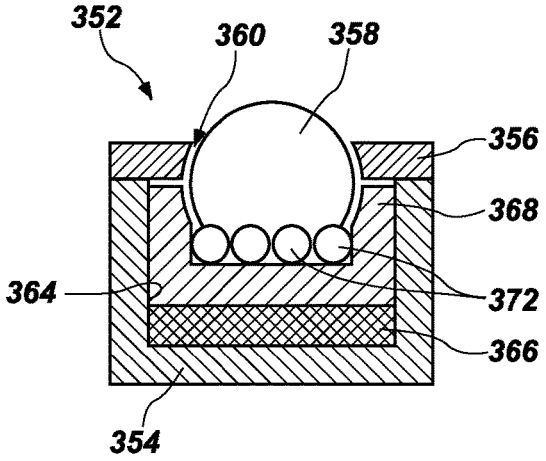

In some embodiments, a lubricant chamber 374 may be provided within the bit body 102 and may be filled with a lubricating. The lubricant chamber 374 may be provided with a plug 376 shown in an uninstalled position in FIG. 30. Lubricating fluid may flow between the rolling element 358 and the support plate 368 to facilitate rotation of the rolling element 358. In other embodiments, bearing balls 372 may be provided on the support plate 368 and about the rolling element 358 to facilitate rotation of the rolling element 358, as illustrated in FIG. 31, which illustrates an embodiment of the gauge feature 352 in isolation from the blade 104. The gauge feature 352 may be retained on the blade 104 by an O-ring or other mechanism such as welding or brazing.

In addition, the rolling element 358 may be translatable along an axis extending centrally through the aperture 360 of the upper retaining member such that the rolling element 358 may exhibit one translational degree of freedom. Accordingly, the rolling element 358, which may define a radially outermost surface along the gauge region 350, may be adjustable between an extended position and a retracted position. As illustrated in FIG. 30, the rolling element 358 is in the extended position. In some embodiments, the rolling element 358 may extend beyond the linear cutting edge 115 of the gauge trimmer 114 such that the rolling element 358 extends beyond the outer diameter of the bit 100. In other embodiments, the rolling element 358 may be coextensive with the linear cutting edge 115 of the gauge trimmer 114 such that the rolling element 358 defines the outer diameter of the bit 100. In yet other embodiments, the rolling element 358 may be recessed relative to the linear cutting edge 115 of the gauge trimmer 114.

A drill bit having a gauge region configuration according to any of the foregoing embodiments may be coupled to a drill string including a steerable bottom hole assembly configured to directionally drill a borehole. In some embodiments, the steerable bottom hole assembly may comprise positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string. In other embodiments, the steerable bottom hole assemblies may comprise a bent adjustable kick off (AKO) sub.

In operation, the drill bit having gauge region configurations according to any of the foregoing embodiments may exhibit the amount of side-cutting as a function of increasing lateral force and/or the surface area engagement as a function of bit tilt angle as previously described with reference to FIGS. 5B and 6. Accordingly, the drill bits according to any of the foregoing embodiment may exhibit a decreased potential to walk or drift as the drill bit is used to directionally drill a borehole and may improve the quality and length of the straight portions of the borehole.

Additional non limiting example embodiments of the disclosure are described below:

Embodiment 1

A drill bit for removing subterranean formation material in a borehole comprising a bit body comprising a longitudinal axis, a blade extending radially outward from the longitudinal axis along a face region of the bit body and extending axially along a gauge region of the bit body, a gauge feature provided in the gauge region of the blade, and a recessed region extending axially below the gauge feature in the gauge region of the blade. The gauge feature comprises an outermost surface extending radially beyond an outer surface of the blade in the recessed region. At least one of the outermost surface of the gauge feature and the outer surface of the blade in the recessed region is radially recessed relative to an outer diameter of the bit.

Embodiment 2

The drill bit of Embodiment 1, wherein each of the outermost surface of the gauge feature and the outer surface of the blade in the recessed region is radially recessed relative to the outer diameter of the bit.

Embodiment 3

The drill bit of either of Embodiments 1 or 2, wherein a radial distance by which at least one of the outermost surface of the gauge feature and the outer surface of the blade in the recessed region is in a range extending from about 0.005 inch (0.127 mm) to about 0.020 inch (0.508 mm).

Embodiment 4

The drill bit of either of any Embodiments 1 through 3, further comprising a cutting element mounted on the gauge feature.

Embodiment 5

The drill bit of either of Embodiments 1 through 4, wherein the cutting element is mounted at a back rake angle in a range extending from about 87 degrees to about 90 degrees.

Embodiment 6

The drill bit of either of Embodiments 1 through 5, wherein a radially outermost surface of the cutting element is coextensive with the radially outermost surface of the gauge feature.

Embodiment 7

The drill bit of either of Embodiments 1 through 6, wherein the gauge feature extends from a rotationally leading edge to a rotationally trailing edge of the blade such that a width of the gauge feature is coextensive with a width of the blade.

Embodiment 8

The drill bit of either of Embodiments 1 through 7, wherein a radial extension of the radially outermost surface of the gauge feature relative to the longitudinal axis is substantially constant as the gauge feature extends between a rotationally leading edge and a rotationally trailing edge of the blade.

Embodiment 9

The drill bit of either of Embodiments 1 through 8, wherein a length of the gauge feature measured in a directional parallel to the longitudinal axis of the bit tapers between the rotationally leading edge and the rotationally trailing edge of the blade.

Embodiment 10

The drill bit of either of Embodiments 1 through 9, wherein the outer surface of the gauge feature is recessed relative to the outer diameter of the bit by a radial distance in a range of from about 0.010 inch (0.254 mm) to about 0.180 inch (4.572 mm).

Embodiment 11

A directional drilling system comprising a steerable bottom hole assembly operably coupled to the drill bit of any of Embodiments 1 through 10.

Embodiments 12

A drill bit for removing subterranean formation material in a borehole comprising a bit body comprising a longitudinal axis, a blade extending radially outward from the longitudinal axis along a face region of the tool body and extending axially along a gauge region of the bit body, a gauge feature in the gauge region of the blade, a first recessed region extending axially above the gauge feature, and a second recessed region extending axially below the gauge feature. The gauge feature comprises a radially outermost surface extending radially beyond outer surfaces of the blade in the first and second recessed regions.

Embodiment 13

The drill bit of Embodiment 12, wherein at least one of the outermost surface of the gauge feature, the outer surface of the blade in the first recessed region, and the outer surface of the blade in the second recessed region is radially recessed relative to an outer diameter of the drill bit.

Embodiment 14

The drill bit of Embodiments 12 or 13, wherein each of the outermost surface of the gauge feature, the outer surface of the blade in the first recessed region, and the outer surface of the blade in the second recessed region is radially recessed relative to the outer diameter of the drill bit.

Embodiment 15

The drill bit of either of Embodiments 12 through 14, further comprising a cutting element or a wear-resistant insert mounted thereon.

Embodiment 16

A method of drilling a borehole in a subterranean formation comprising rotating a bit about a longitudinal axis thereof, engaging a subterranean formation with at least a portion of a gauge region of a blade of the bit. The gauge region comprises a recessed region comprising a radially outer surface of the blade and a gauge feature comprising a radially outermost surface extending radially beyond the radially outer surface of the blade in the at least one recessed region. The method further includes increasing a tilt angle of the bit such that the radially outermost surface of the gauge feature and the radially outer surface of the recessed region are consecutively engaged with the subterranean formation with increasing tilt angle.

Embodiment 17

The method of Embodiment 16, wherein increasing the tilt angle of the bit comprises increasing a lateral force applied on the bit in a direction substantially perpendicular to the longitudinal axis such that the gauge feature engages the subterranean formation and such that side cutting exhibited by the bit is initially minimal and substantially constant and subsequently increases in a substantially linear manner with increasing lateral force.

Embodiment 18

The method of Embodiment 17, wherein increasing the lateral force applied on the bit such that side cutting exhibited by the bit is initially minimal and substantially constant comprises maintaining a substantially constant surface area of the gauge feature in contact with the subterranean formation with increasing applied lateral force.

Embodiment 19

The method of any of Embodiments 17 or 18, wherein increasing the lateral force applied on the bit such that side cutting exhibited by the bit is substantially linear manner with increasing lateral force comprises increasing a surface area of the gauge region in contact with the subterranean formation with increasing applied lateral force.

Embodiment 20

The method of any of Embodiments 16 through 19, further comprising increasing a lateral force applied on the bit in a direction substantially perpendicular to the longitudinal axis such that side cutting exhibited by the bit is subsequently maximized and substantially constant after increasing side cutting exhibited by the bit in the substantially linear manner.

While the disclosed structures and methods are susceptible to various modifications and alternative forms in implementation thereof, specific embodiments have been shown by way of example in the drawings and have been described in detail herein. However, it should be understood that the present disclosure is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. A drill bit for removing subterranean formation material in a borehole, comprising:

a bit body comprising a longitudinal axis;

a blade extending radially outward from the longitudinal axis along a face region of the bit body and extending axially along a gauge region of the bit body;

a gauge trimmer defining an outer diameter of the drill bit;

a gauge feature provided in the gauge region of the blade; and a recessed region extending axially below the gauge feature in the gauge region of the blade;

wherein the gauge feature comprises an outermost surface extending radially beyond an outer surface of the blade in the recessed region and wherein a radial distance by which at least one of the outermost surface of the gauge feature and the outer surface of the blade in the recessed region is recessed from the outer diameter of the drill bit is in a range extending from about 0.005 inch (0.127 mm) to about 0.180 inch (4.572 mm).

2. The drill bit of claim 1, wherein each of the outermost surface of the gauge feature and the outer surface of the blade in the recessed region is radially recessed relative to the outer diameter of the drill bit.

3. The drill bit of claim 1, wherein a radial distance by which at least one of the outermost surface of the gauge feature and the outer surface of the blade in the recessed region is recessed from the outer diameter of the drill bit is in a range extending from about 0.005 inch (0.127 mm) to about 0.020 inch (0.508 mm).

4. The drill bit of claim 1, further comprising a cutting element mounted on the gauge feature.

5. The drill bit of claim 4, wherein the cutting element is mounted at a back rake angle in a range extending from about 87 degrees to about 90 degrees.

6. The drill bit of claim 4, wherein a radially outermost surface of the cutting element is coextensive with the radially outermost surface of the gauge feature.

7. The drill bit of claim 1, wherein the gauge feature extends from a rotationally leading edge to a rotationally trailing edge of the blade such that a width of the gauge feature is coextensive with a width of the blade.

8. The drill bit of claim 7, wherein a radial extension of the radially outermost surface of the gauge feature relative to the longitudinal axis is substantially constant as the gauge feature extends between a rotationally leading edge and a rotationally trailing edge of the blade.

9. The drill bit of claim 7, wherein a length of the gauge feature measured in a directional parallel to the longitudinal axis of the drill bit tapers between the rotationally leading edge and the rotationally trailing edge of the blade.

10. The drill bit of claim 1, wherein the outer surface of the gauge feature is recessed relative to the outer diameter of the drill bit by a radial distance in a range of from about 0.010 inch (0.254 mm) to about 0.180 inch (4.572 mm).

11. A directional drilling system comprising a steerable bottom hole assembly operably coupled to the drill bit of claim 1.

12. A drill bit for removing subterranean formation material in a borehole, comprising:

a bit body comprising a longitudinal axis;

a blade extending radially outward from the longitudinal axis along a face region of the bit body and extending axially along a gauge region of the bit body;

a gauge trimmer defining an outer diameter of the drill bit;

a gauge feature provided on the blade in the gauge region;

a first recessed region extending axially above the gauge feature; and a second recessed region extending axially below the gauge feature;

wherein the gauge feature comprises a radially outermost surface extending radially beyond outer surfaces of the blade in the first and second recessed regions, and wherein the outer surface of the blade in the first recessed region, and the outer surface of the blade in the second recessed region are radially recessed relative to the outer diameter of the drill bit, wherein the outer surface of the blade in at least one of the first recessed region and the second recessed region is recessed from the outer diameter of the drill bit in a range extending from about 0.005 inch (0.127 mm) to about 0.180 inch (4.572 mm).

13. The drill bit of claim 12, further comprising a cutting element or a wear-resistant insert mounted thereon.

14. A method of drilling a borehole in a subterranean formation, comprising:

rotating a bit about a longitudinal axis thereof;

engaging a subterranean formation with at least a portion of a gauge region of a blade of the bit, the gauge region comprising:

a recessed region comprising a radially outer surface of the blade; and a gauge feature comprising a radially outermost surface extending radially beyond the radially outer surface of the blade in the recessed region;

increasing a tilt angle of the bit such that the radially outermost surface of the gauge feature and the radially outer surface of the recessed region are consecutively engaged with the subterranean formation when the tilt angle of the bit increases beyond a threshold angle, wherein side cutting exhibited by the bit increases in a substantially linear manner with a lateral force;

increasing the lateral force applied on the bit in a direction substantially perpendicular to the longitudinal axis such that the gauge feature engages the subterranean formation and such that side cutting exhibited by the bit is initially minimal and substantially constant below the threshold angle and subsequently increases in the substantially linear manner with increasing lateral force; and controlling a surface area of the gauge region in contact with the subterranean formation as a function of the tilt angle.

15. The method of claim 14 wherein increasing the lateral force applied on the bit such that side cutting exhibited by the bit is initially minimal and substantially constant comprises maintaining a substantially constant surface area of the gauge feature in contact with the subterranean formation with increasing applied lateral force below the threshold angle.

16. The method of claim 14, wherein increasing the lateral force applied on the bit such that side cutting exhibited by the bit is substantially linear manner with increasing lateral force comprises increasing a surface area of the gauge region in contact with the subterranean formation with increasing applied lateral force above the threshold angle.

17. The method of claim 14, further comprising increasing a lateral force applied on the bit in a direction substantially perpendicular to the longitudinal axis such that side cutting exhibited by the bit is subsequently maximized and substantially constant after increasing side cutting exhibited by the bit in the substantially linear manner.

* * * * *